US012084248B2

(12) United States Patent
Guzman et al.

(10) Patent No.: US 12,084,248 B2
(45) Date of Patent: Sep. 10, 2024

(54) POUCHES FOR DISPENSING PRODUCTS

(71) Applicant: Cryovac, LLC, Charlotte, NC (US)

(72) Inventors: Jorge Fernando Guzman, Greer, SC (US); Ward Jones, Charlotte, NC (US); Michael Lindler, Charlotte, NC (US); Scott Daigle, Charlotte, NC (US); Hubert J. Cook, Simpsonville, SC (US)

(73) Assignee: Cryovac, LLC, Charlotte, NC (US)

( * ) Notice: Subject to any disclaimer, the term of this patent is extended or adjusted under 35 U.S.C. 154(b) by 293 days.

(21) Appl. No.: 17/628,251

(22) PCT Filed: Jul. 22, 2020

(86) PCT No.: PCT/US2020/042948
§ 371 (c)(1),
(2) Date: Jan. 19, 2022

(87) PCT Pub. No.: WO2021/016283
PCT Pub. Date: Jan. 28, 2021

(65) Prior Publication Data

US 2022/0258944 A1 Aug. 18, 2022

Related U.S. Application Data

(60) Provisional application No. 62/877,425, filed on Jul. 23, 2019.

(51) Int. Cl.
*B65D 75/58* (2006.01)
*B65D 75/30* (2006.01)

(52) U.S. Cl.
CPC ..... *B65D 75/5811* (2013.01); *B65D 75/30* (2013.01)

(58) Field of Classification Search
CPC .... B65D 75/5811; B65D 75/30; B65D 33/16; B65D 75/5861
USPC ..... 222/107
See application file for complete search history.

(56) References Cited

U.S. PATENT DOCUMENTS

| | | | |
|---|---|---|---|
| 3,815,794 | A | 6/1974 | Carlisle |
| 3,878,977 | A | 4/1975 | Carlisle |
| 4,312,689 | A | 1/1982 | Amneus |
| 5,529,224 | A | 6/1996 | Chan et al. |
| 6,983,839 | B2 | 1/2006 | Bertram et al. |
| 9,586,727 | B2 | 3/2017 | Nathan |
| 10,179,343 | B2 | 1/2019 | Compton et al. |
| 2003/0230605 | A1 | 12/2003 | Simmons |

(Continued)

FOREIGN PATENT DOCUMENTS

| | | | |
|---|---|---|---|
| EP | 0226290 | A2 | 6/1987 |
| WO | 2016018694 | A2 | 2/2016 |

*Primary Examiner* — Ishal Pancholi
(74) *Attorney, Agent, or Firm* — Jon M. Isaacson

(57) ABSTRACT

A package includes a first panel and a second panel. The first and second panels are sealed to each other to form a pouch (200). The pouch includes a main section and a channel section. The package further includes a product disposed within the pouch. The product is capable of flowing from the main section through the channel section to a tip (212) of the pouch. The pouch includes a valve (224) that has a curve extending transversely across the channel section. The curve is configured such that, when the product flows through the curve, the product flows by a convex side of the first panel in the curve and a concave side of the second panel in the curve.

20 Claims, 12 Drawing Sheets

(56) References Cited

U.S. PATENT DOCUMENTS

| | | | | |
|---|---|---|---|---|
| 2006/0093765 | A1 | 5/2006 | Mueller | |
| 2007/0131713 | A1 | 6/2007 | Hill | |
| 2015/0114987 | A1 | 4/2015 | Pritchard | |
| 2019/0105683 | A1* | 4/2019 | Compton | B05C 17/00553 |

* cited by examiner

POUCHES FOR DISPENSING PRODUCTS

BACKGROUND

The present disclosure is in the technical field of dispensing systems for dispensing packaged products. More particularly, the present disclosure is directed to pouches for dispensing product where the pouches include valves that open when a force is applied to the exterior of the pouch and close when an external force is not applied to the pouch.

In food service, and in particular in the field of high-volume fast food service, it is frequently desired that food be supplemented by condiments such as ketchup, mustard, mayonnaise, and the like. It has recently become customary in retail fast service chain food outlets to use a wide variety of devices to dispense a measured quantity of flowable product. For example, a trigger-activated dispensing gun assembly has commonly been used in "back of the restaurant" operations for discharging one or more condiments or sauces. The gun assembly dispenses a quantity of a condiment with each pull of a gun trigger. The gun assembly includes a cylindrical container that houses the condiment and cooperates with a trigger in a gun to dispense the condiment out of a nozzle. However, the gun, cylindrical container, and nozzle are typically disassembled and/or cleaned each time the container is emptied and/or refilled. In addition, the gun assembly typically can be messy, as condiment can drip from the nozzle between uses; conventional systems can be labor intensive; and the container can sometimes become damaged and not insert properly into the gun. It would be advantageous in some circumstances to avoid the use of a gun or other dispenser that needs to be cleaned.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, a package includes a first panel and a second panel. The first and second panels are sealed to each other to form a pouch and the pouch includes a main section and a channel section. The package further includes a product disposed within the pouch and the product is capable of flowing from the main section through the channel section to a tip of the pouch. The pouch includes a valve that has a curve extending transversely across the channel section. The curve is configured such that, when the product flows through the curve, the product flows by a convex side of the first panel in the curve and a concave side of the second panel in the curve.

In a second embodiment, an initiation pressure of the valve of the first embodiment is in a range from about 0.4 psi (2.8 kPa) to about 3.4 psi (23.4 kPa).

In a third embodiment, the initiation pressure of the valve of the second embodiment is at least about 0.9 psi (6.2 kPa).

In a fourth embodiment, the initiation pressure of the valve of the second embodiment is at most about 1.6 psi (11.0 kPa).

In a fifth embodiment, an initiation pressure of the valve of the first embodiment is in a range from about 0.9 psi (6.2 kPa) to about 1.6 psi (11.0 kPa).

In a sixth embodiment, a portion of the first panel of any of the previous embodiments that includes the curve is less rigid than a portion of the second panel that includes the curve.

In a seventh embodiment, the portion of the second panel of the sixth embodiment that includes the curve has a valve deflection constant defined as:

$$C_{VD} = \frac{Et}{D}$$

where $C_{VD}$ is the valve deflection constant, E is a modulus of elasticity of the portion of the second panel, t is a thickness of the portion of the second panel, and D is a diameter of the concave side of the second panel in the curve when the pouch is in a resting state.

In an eight embodiment, the valve deflection constant of the seventh embodiment is in a range from about 6.75 kpsi (46.5 MPa) to about 13.5 kpsi (92.4 MPa).

In a ninth embodiment, the valve deflection constant of the eighth embodiment is at least about 8.5 kpsi (58.6 MPa).

In a tenth embodiment, the valve deflection constant of the eighth embodiment is at most about 12.9 kpsi (88.9 MPa).

In an eleventh embodiment, the valve deflection constant of the seventh embodiment is in a range from about 8.5 kpsi (58.6 MPa) to about 12.9 kpsi (88.9 MPa).

In a twelfth embodiment, the portion of the first panel of any of the seventh through eleventh embodiments that includes the curve has a valve deflection constant that is less than or equal to 40% of the valve deflection constant of the portion of the second panel.

In a thirteenth embodiment, the valve deflection constant of the portion of the first panel of the twelfth embodiment is less than or equal to 20% of the valve deflection constant of the portion of the second panel.

In a fourteenth embodiment, the valve deflection constant of the portion of the first panel of the twelfth embodiment is less than or equal to 10% of the valve deflection constant of the portion of the second panel.

In a fifteenth embodiment, the diameter of the concave side of the second panel in the curve of any of the seventh to fourteenth embodiments is a diameter of a most acute curvature of the concave side of the second panel in the curve.

In a sixteenth embodiment, the first panel of any of the sixth to fifteenth embodiments includes a first film and the second panel includes a second film.

In a seventeenth embodiment, a rigidity of the second film of the sixteenth embodiment is greater than a rigidity of the first film.

In an eighteenth embodiment, the second panel of and of the sixteenth to seventeenth embodiments further includes a stiffening layer adhered to the second film and the portion of the second panel in the curve includes the stiffening layer.

In a nineteenth embodiment, a rigidity of the second film of the eighteenth embodiment is substantially the same as a rigidity of the first film.

In a twentieth embodiment, the first film and the second film of the eighteenth embodiment are formed from a single sheet of film that is folded between the first and second films.

In a twenty first embodiment, the portion of the second panel of the twentieth embodiment that includes the curve has a valve deflection constant defined as:

$$C_{VD} = \frac{Et}{D}$$

where $C_{VD}$ is the valve deflection constant, E is a modulus of elasticity of the portion of the second panel, t is a thickness of the portion of the second panel, and D is a diameter of the concave side of the second panel in the curve when the pouch is in a resting state.

In a twenty second embodiment, a ratio of a product of a thickness and a modulus of elasticity of the second film to a product of a thickness and a modulus of elasticity of the stiffening layer of any of the eighteenth to twenty first embodiments is less than or equal to about 1:4.

In a twenty third embodiment, the package of any of the previous embodiments includes a frangible seal between the first and second panels located such that the valve is between the tip of the package and the frangible seal, wherein, before the frangible seal is broken, the frangible seal is configured to deter flow of the product to the valve.

In a twenty fourth embodiment, the tip of the package of the twenty third embodiment is open before the frangible seal is broken.

In a twenty fifth embodiment, the product of any of the previous embodiments includes at least one of a condiment or a liquid.

In a twenty sixth embodiment, a method can be performed to dispense a product from a package. The package includes a first panel and a second panel. The first and second panels are sealed to each other to form a pouch. The pouch includes a main section and a channel section. A product is disposed within the main section of the pouch. The method includes applying an external force to the main section of the pouch. Applying the external force causes (i) the product to flow from the main section to a valve in the channel section, where the valve has a curve extending transversely across the channel section, (ii) the curve in the valve to straighten at least partially from a shape of the curve in a resting state of the pouch, (iii) the product to flow through the curve by a convex side of the first panel in the curve and a concave side of the second panel in the curve, (iv) and the product to be dispensed from a tip of the pouch. The method further includes reducing the external force applied to the main section of the pouch. Reducing the external force causes the valve to return to the shape of the curve in a resting state of the pouch to deter flow of the product through the valve.

In a twenty seventh embodiment, the applying of the external force to the main section of the pouch of the twenty second embodiment includes manually applying the external force to the main section of the pouch.

In a twenty eighth embodiment, the applying the external force in any of the twenty sixth or twenty seventh embodiment further causes a break of a frangible seal in the pouch. Before the frangible seal is broken, the frangible seal is between the first and second panels and located such that the valve is between the tip of the pouch and the frangible seal.

In a twenty ninth embodiment, the method of any of the twenty sixth to twenty eighth embodiments further includes opening the tip of the pouch before applying the external force.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1A:
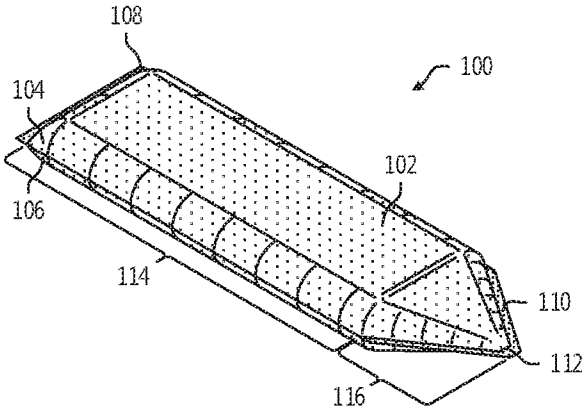
FIGS. 1A to 1D depict an embodiment of a pouch with a product disposed therein and a series of instances of a process of dispensing the product from the pouch, in accordance with the embodiments disclosed herein.

The present disclosure describes embodiments of pouches that are useable to dispense products without the use of a dispenser. In some embodiments, the pouches have valves that dispense product when a force is manually applied to an exterior of the pouch and close to prevent leakage of the product when the force on the exterior of the pouches is reduced. In one embodiment, a package includes a first panel and a second panel that are sealed to each other to form a pouch. The pouch includes a main section and a channel section. The package further includes a product disposed within the pouch. The product is capable of flowing from the main section through the channel section to a tip of the pouch. The pouch includes a valve that has a curve extending transversely across the channel section. The curve is configured such that, when the product flows through the curve, the product flows by a convex side of the first panel in the curve and a concave side of the second panel in the curve. In some cases, a portion of the first panel that includes the curve is less rigid than a portion of the second panel that includes the curve. The valve can open to dispense product when a force is applied to an exterior of the pouch and the more-rigid concave panel can cause the valve to close when the force on the exterior of the pouch is reduced.

As used here, an "abuse layer" and the like refer to an outer film layer and/or an inner film layer, so long as the film layer serves to resist abrasion, puncture, and other potential causes of reduction of package integrity, as well as potential causes of reduction of package appearance quality. Abuse layers can comprise any polymer, so long as the polymer contributes to achieving an integrity goal and/or an appearance goal. In some embodiments, the abuse layer can comprise polyamide, ethylene/propylene copolymer, and/or combinations thereof.

As used here, "antifog" and the like refer to an agent that can be incorporated into an outermost film layer, be coated onto an outermost film layer, or migrate from an internal layer to an outermost film layer, with the effect of lowering the seal strength of a seal subsequently made. Suitable antifog agents may fall into classes such as esters of aliphatic alcohols, esters of polyglycol, polyethers, polyhydric alcohols, esters of polyhydric aliphatic alcohols, polyethoxylated aromatic alcohols, nonionic ethoxylates, and hydrophilic fatty acid esters. Useful antifog agents include polyoxyethylene, sorbitan monostearate, polyoxyethylene sorbitan monolaurate, polyoxyethylene monopalmitate, polyoxyethylene sorbitan tristearate, polyoxyethylene sorbitan trioleate, poly(oxypropylene), polyethoxylated fatty alcohols, polyoxyethylated 4-nonylphenol, polyhydric alcohol, propylene diol, propylene triol, and ethylene diol, monoglyceride esters of vegetable oil or animal fat, mono- and/or diglycerides such as glycerol mono- and dioleate, glyceryl stearate, monophenyl polyethoxylate, and sorbitan monolaurate. The antifog agent is incorporated in an amount effective to suitably reduce the seal strength of the film.

As used herein, "barrier", "barrier layer", and the like refer to the ability of a film or film layer to serve as a barrier to one or more gases. For example, oxygen barrier layers can comprise, but are not limited to, ethylene/vinyl alcohol copolymer, polyvinyl chloride, polyvinylidene chloride, polyamide, polyester, polyacrylonitrile, and the like, as known to those of ordinary skill in the art. In some embodiments, the barrier film or layer has an oxygen transmission rate of no more than 100 cc $O_2/m^2$·day·atm; less than 50 cc $O_2/m^2$·day·atm; less than 25 cc $O_2/m^2$·day·atm; less than 10 cc $O_2/m^2$·day·atm; less than 5 cc $O_2/m^2$·day·atm; or less than 1 cc $O_2/m^2$·day·atm (tested at 1 mil thick and at 25° C. in accordance with ASTM D3985, herein incorporated by reference in its entirety).

As used herein, "bulk layer" and the like refer to any layer of a film that is present for the purpose of increasing the abuse-resistance, toughness, and/or modulus of a film. In some embodiments, bulk layers can comprise polyolefin, ethylene/alpha-olefin copolymer, ethylene/alpha-olefin copolymer plastomer, low density polyethylene, linear low density polyethylene, and combinations thereof.

As used herein, "condiment" and the like refer to (but is not limited to) ketchup, mustard, guacamole, sour cream, salsa, nacho cheese, taco sauce, barbecue sauce, tartar sauce, mayonnaise, jams, jellies, spices, and the like. In some embodiments, the term "condiment" can include any and all additives that a user can choose to add to any food item for any purpose, e.g. for organoleptic, processing, or preservative purposes.

As used herein, "container" and the like refer to tubes, bottles, jars, tubs, cylinders, vessels, flasks, chambers, and the like, whether pliable or rigid.

As used herein, "exterior" and the like refer to the outside portion of an article.

As used herein, "filled" and the like, with respect to a pouch, refer to a pouch that has been filled with a product in a manner consistent with a commercial filling operation. Thus, a pouch may or may not be 100% filled.

As used herein, "film" and the like refer to a laminate, sheet, web, coating, or the like, that can be used to package a product. The film can be a rigid, semi-rigid, or flexible product. In some embodiments, the film is produced as a fully coextruded film, i.e., all layers of the film emerging from a single die at the same time. In some embodiments, the film is made using a flat cast film production process or a round cast film production process. Alternatively, the film can be made using a blown film process, double bubble process, triple bubble process, or adhesive or extrusion coating lamination.

As used herein, "flexible" and the like refer to materials that are pliable and easily deform in the presence of external forces.

As used herein, "frangible seal" and the like refer to a seal that is sufficiently durable to allow normal handling and storage, but ruptures or substantially ruptures under applied pressure. In some embodiments, suitable frangible seals will have a peel strength of from 0.5 to less than 5 pounds/inch as measured by ASTM F88.

As used herein, "heat seal" and the like refer to any seal of a first region of a film surface to a second region of a film surface, wherein the seal is formed by heating the regions to at least their respective seal initiation temperatures. Heat-sealing is the process of joining two or more thermoplastic films or sheets by heating areas in contact with each other to the temperature at which fusion occurs, usually aided by pressure. In some embodiments, heat-sealing can be inclusive of thermal sealing, melt-bead sealing, impulse sealing, dielectric sealing, and/or ultrasonic sealing. The heating can be performed by any one or more of a wide variety of means, such as (but not limited to) a heated bar, hot wire, hot air, infrared radiation, ultrasonic sealing, and the like.

As used herein, "interior" and the like refer to the inside portion of an article.

As used herein, "label" and the like refer to a portion of sheet or film material that can be used to construct a frangible seal in accordance with some embodiments of the frangible seals.

As used herein, "multilayer film" and the like refer to a thermoplastic film having one or more layers formed from polymeric or other materials that are bonded together by any conventional or suitable method, including one or more of the following methods: coextrusion, extrusion coating, lamination, vapor deposition coating, solvent coating, emulsion coating, or suspension coating.

As used herein, "outlet" and the like refer to an aperture, orifice, opening, chute, passage, or similar channel through which a product can exit the disclosed packaging system.

As used herein, "panel" and the like herein refer to a wall or major section of a pouch. A first and second panel can be derived from two pieces of film joined together by any suitable means, such as heat sealing. Alternatively, a single web of film can be folded into a tubular configuration, and longitudinally and transversely sealed to create a pouch exhibiting a first and second panel.

As used herein, "peelable sealant" and the like refer to any suitable polymer or polymer blend that forms at least a part of a film layer or is applied to a film layer, wherein the peelable sealant exhibits a seal strength that is less than the seal strength of the permanent sealant as described herein. In some embodiments, the peelable sealant can comprise a food grade cold seal adhesive.

As used herein, "permanent sealant" and the like refer to any suitable polymer or polymer blend that forms at least a part of a film layer or is applied to a film layer, wherein the permanent layer exhibits a seal strength that is greater than the seal strength of the peelable sealant as described herein.

As used herein, "pouch" and the like refer to any of a wide variety of containers known in the art, including (but not limited to) bags, packets, packages, and the like.

As used herein, "product" and the like refer to any of a wide variety of food or non-food items that can be packaged in the disclosed systems. In some embodiments, the product is a condiment, and/or a flowable product.

As used herein, "seal" and the like herein refer to any seal of a first region of a film surface to a second region of a film or substrate surface. In some embodiments, the seal can be formed by heating the regions to at least their respective seal initiation temperatures using a heated bar, hot air, infrared radiation, ultrasonic sealing, and the like. In some embodiments, the seal can be formed by an adhesive. Alternatively, or in addition, in some embodiments the seal can be formed using a UV or e-beam curable adhesive seal.

As used herein, "seal layer" and the like refer to an outermost film layer or layers involved in heat sealing of the film to itself, to another film layer of the same or another film, and/or another article that is not a film. "Outermost" layer herein includes a layer found on the outside of a film, i.e. a layer not bounded on both major surfaces by another film layer. Layers involved in heat sealing can include a second layer, adjacent an outermost layer, that assists in or substantially affects or influences the overall strength of the heat seal. Heat sealing can be performed by any one or more of a wide variety of manners known to those of ordinary skill in art, including using heat seal technique (e.g., melt-bead sealing, thermal sealing, impulse sealing, ultrasonic sealing, hot air, hot wire, infrared radiation, and the like), adhesive sealing, UV-curable adhesive sealing, and the like.

As used herein, "tie layer" and the like refer to an internal film layer having the primary purpose of adhering two layers to one another. In some embodiments, a tie layer can comprise any nonpolar polymer having a polar group grafted thereon, such that the polymer is capable of covalent bonding to polar polymers such as polyamide and ethylene/vinyl alcohol copolymer. In some embodiments, the tie layers can comprise modified polyolefin, modified ethylene/vinyl acetate copolymer, and/or homogeneous ethylene/alpha-olefin copolymer.

As used herein, "transparent" and the like refer to the ability of a material to transmit incident light with negligible scattering and little absorption, enabling objects to be seen clearly through the material under typical unaided viewing conditions, i.e. the expected use conditions of the material, as measured in accordance with ASTM D1746.

As used herein, "valve" and the like refer to any device by which the flow of material can be started, stopped, rerouted or regulated by a movable part that opens, closes, or partially obstructs a passageway through which the material flows. In some embodiments, a suitable valve can comprise any of an umbrella valve, duckbill valve, reed valve, ball valve, flapper valve, poppet valve, Gott valve, check valve, or any suitable combination thereof.

All compositional percentages used herein are presented on a "by weight" basis, unless designated otherwise.

The definitions and disclosure of the present application control over any inconsistent definition or disclosure present in an incorporated reference.

Depicted in FIGS. 1A to 1D are an embodiment of a pouch 100 with a product 102 disposed therein. The pouch 100 can be any of a variety of pouches known in the art, including, for example, a stand-up pouch, a gusseted stand-up pouch, a lay-flat pouch, a pouch comprising at least one longitudinal seal, and the like. In some embodiments, the pouch 100 includes a pair of films joined together along a pair of opposing sides and a bottom bridging the sides. Alternatively, in some embodiments, the pouch 100 can be formed from a single film that has been center folded at one edge, or a pouch that includes one or more lap seals, fin seals, and/or edge seals. In another embodiment, the pouch 100 can comprise a continuous tubular material with no longitudinal seal, but with transverse seals to form transverse ends of the pouch 100. The description of pouches herein as having "first and second panels" should be understood to describe a pouch that when filled with product and laid on a surface, will display a major first surface, wall or panel, and, on the opposite side of the pouch, a second major surface, wall, or panel.

In the depicted embodiment, the pouch 100 includes a first panel 104 and a second panel 106 that are sealed together about the pouch perimeter with one or more perimeter seals. Perimeter seals can be formed using any suitable method, known and used in the art, such as by the use of heat, pressure, adhesive, and/or mechanical closure. In the depicted embodiment, the perimeter seals include a transverse seal 108 and a channel seal 110. The transverse seal 108 extends directly between longitudinal sides of the pouch 100 to seal one end of the pouch 100. The channel seal 110 extends indirectly between longitudinal sides of the pouch 100 to seal the other end of the pouch 100. The channel seal 110 is shaped to form a tip 112 from which the product 102 can be dispensed. The pouch 100 includes a main section 114 and a channel section 116. The main section 114 is generally the portion of the pouch 100 between the transverse seal 108 and the channel seal 110. The channel section 116 is generally the portion of the pouch 100 between the start of the channel seal 110 and the tip 112.

FIGS. 1A to 1D also depict a series of instances of a process of dispensing the product 102 from the pouch 100. In FIG. 1A, the pouch 100 is sealed closed with the product 102 disposed therein. In some embodiments, the product 102 includes a flowable product, such a condiment or a liquid. For example, in the case where the product 102 is a condiment, the condiment may be mustard, ketchup, salsa, guacamole, cheese sauce, sour cream, taco sauce, mayonnaise, tartar sauce, syrup, gravy, hot fudge, caramel, butterscotch toppings, flowable margarine or butter, horseradish, creamers, cream, yogurt, jelly, peanut butter, salad dressing, or any other type of condiment. In examples where the product 102 is a liquid, the liquid may be water, milk, lemonade, oil, or any other type of liquid.

Figure 1B:
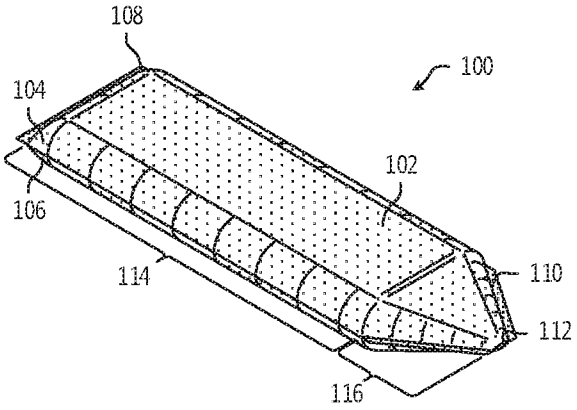
Figure 1C:
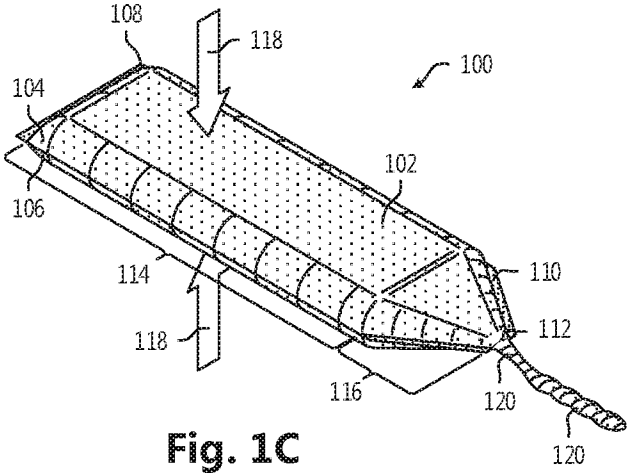

In FIG. 1B, the tip 112 has been opened. In the depicted embodiment, the tip 112 was opened by a user cutting off the end of the channel seal 110 so that the tip 112 includes a gap between portions of the first and second panels 104 and 106. Under certain conditions, the product 102 is capable of flowing out of the pouch 100 through the gap in the first and second panels 104 and 106. In some embodiments, the end of the channel seal 110 is cut using a tool, such as a pair of scissors or a knife. In other embodiments, the channel seal 110 can include a notch or slit that permits a user to remove the end of the channel seal 110 manually by pulling on a tab formed by the notch or slit. In other embodiments, the tip 112 can be manufactured with a gap and the pouch 100 can include a frangible seal that seals the product 102 in the pouch 100 until the frangible seal is broken. Examples of frangible seals are described in U.S. Pat. Nos. 6,983,839, 10,179,343, and U.S. Patent Application Publication No. 2006/0093765, the contents of each of which are hereby incorporated by reference in their entirety.

In FIG. 10, pressure 118 is applied to the first and second panels 104 and 106. In some embodiments, the pressure 118 can be applied by a user manually. For example, a user can grasp the pouch 100 and squeeze the first and second panels 104 and 106 toward each other in order to apply the pressure 118. In other embodiments, the pressure 118 can be applied mechanically (e.g., by a dispenser, such as a dispenser gun that pushes on the closed end of the pouch 100), pneumatically (e.g., by increasing the gas pressure outside of the pouch 100), or in any other way. The pressure 118 applied to the pouch 100 causes the product 102 is dispensed from the tip 112 as dispensed product 120. Under some conditions, the pressure 118 is sufficient to cause the dispensed product 120 to initially exit the pouch as a stream. Once the stream of the dispensed product 120 reaches a surface (e.g., a table, a tray, a container, a food product, etc.), the dispensed product 120 can accumulate on the surface, as shown in the depicted embodiment.

Figure 1D:
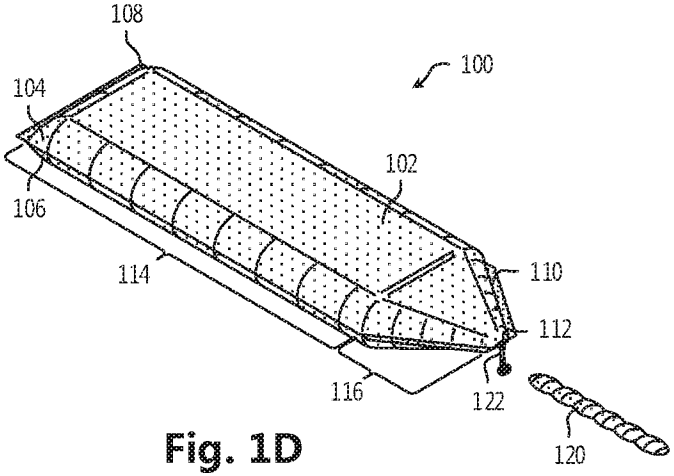
Figure 2B:
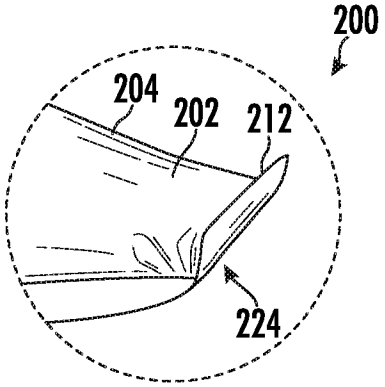
FIGS. 2B, 3B, 4B, 5B, and 6B depict detail views of the tip of the pouch shown in FIGS. 2A, 3A, 4A, 5A, and 6A, respectively, in accordance with the embodiments disclosed herein.
Figure 2D:
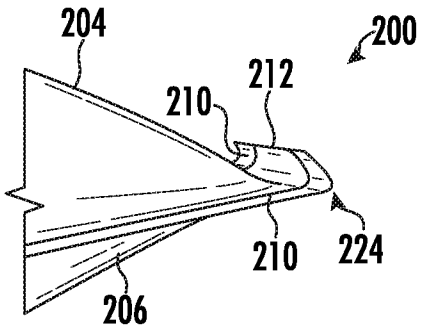
FIGS. 2D, 3D, 4D, 5D, and 6D depict back perspective views of the tip of the pouch alone at, respectively, the first instance shown in FIG. 2A, the second instance shown in FIG. 3A, the third instance shown in FIG. 4A, the fourth instance shown in FIG. 5A, and the fifth instance shown in FIG. 6A, in accordance with the embodiments disclosed herein.
Figure 2A:
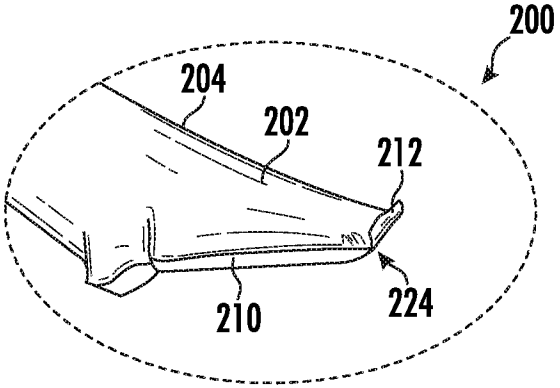
FIGS. 2A, 3A, 4A, 5A, and 6A depict first, second, third, fourth, and fifth instances, respectively, of a process of dispensing product from a pouch with a valve that resists product leakage and is self-closing, in accordance with the embodiments disclosed herein.
Figure 2C:
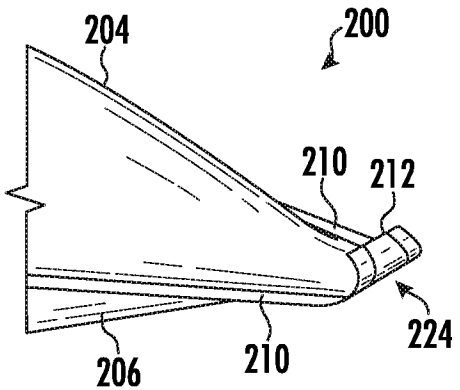
FIGS. 2C, 3C, 4C, 5C, and 6C depict front perspective views of the tip of the pouch alone at, respectively, the first instance shown in FIG. 2A, the second instance shown in FIG. 3A, the third instance shown in FIG. 4A, the fourth instance shown in FIG. 5A, and the fifth instance shown in FIG. 6A, in accordance with the embodiments disclosed herein.
Figure 3B:
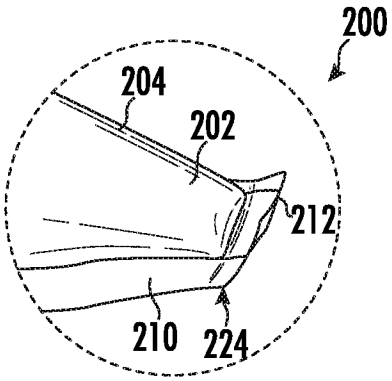
Figure 3D:
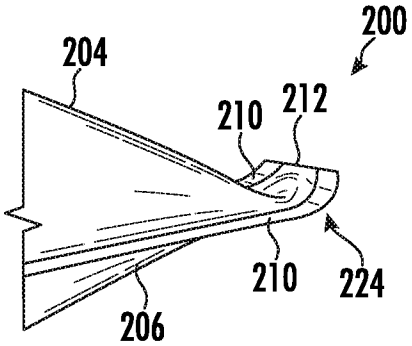
Figure 3A:
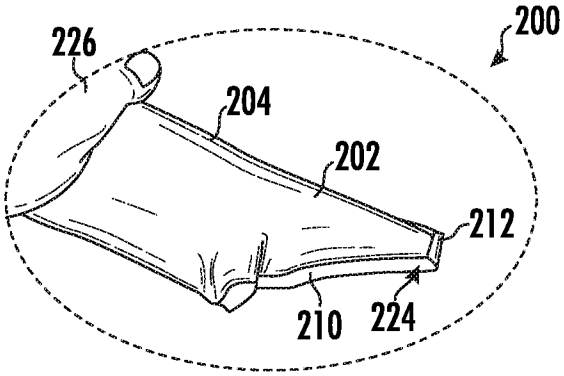
Figure 3C:
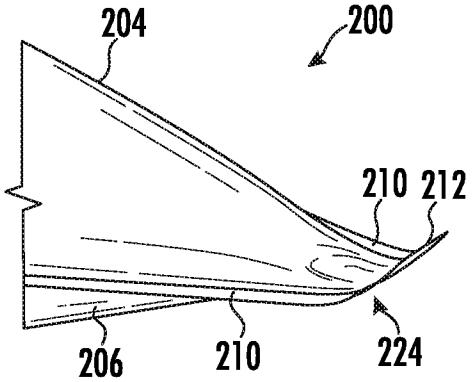

In FIG. 1D, the pressure 118 is no longer applied to the pouch 100. In the depicted embodiment, there is no longer a stream of the dispensed product 120 exiting the tip 112 and the accumulated portions of the dispensed product 120 remain on the surface in front of the pouch 100. However, despite the lack of external pressure applied to the pouch 100, some of the product 102 continues to leak out of the pouch 100 as leaked product 122. In some cases, the leaked product 122 exits the tip 112 as drops or drool of the product 102. In some embodiments, the product 102 is able to pass out of the tip 112 to become leaked product 122 passively, such as under the force of gravity only. In some embodiments, the product 102 passes out of the tip 112 to become leaked product 122 due to inadvertent forces, such as when a user attempts to pick up the pouch 100 and inadvertently squeezes the pouch 100 to cause some of the product 102 to pass through the tip 112. In some embodiments, the ability of the product 102 to inadvertently pass through the tip 112 is dependent on a viscosity of the product 102. For example, a product having a low viscosity (e.g., having a viscosity less than or equal to about 10 mPa·s, such as water or milk) is more likely to inadvertently pass through a pouch tip than a product having a medium viscosity (e.g., having a viscosity in a range from about 10 mPa·s to about 1000 mPa·s, such as olive oil) or a product having a high viscosity (e.g., having a viscosity in a range greater than or equal to about 1000 mPa·s, such as mayonnaise or ketchup).

The pouch 100 shown in FIGS. 1A to 1D has a number of advantages. For example, the pouch 100 may be a convenient package for storing the product 102 before the product 102 is dispensed. The pouch 100 may also be convenient for a user to hold while dispensing the product 102 from the pouch 100. The pouch 100 is also capable of being used to hold and dispense products of different viscosities (e.g., viscoelastic substances, Newtonian fluids, and non-Newtonian fluids). The pouch 100 is also capable of being used to hold and dispense products that are uniform (e.g., water, ketchup, etc.) and non-uniform (e.g., tartar sauce, salsa, pickle relish, etc.). The pouch 100 shown in FIGS. 1A to 1D also has a number of disadvantages. For example, as shown in FIG. 1D, the pouch 100 tends to allow leaked product 122 to exit the tip 112 inadvertently. In another example, after the pouch 100 is opened, the pouch 100 cannot be closed again without the use of an external tool (e.g., a clip) to hold the tip 112 closed. In addition to leaking products, if the pouch 100 is open, the product 102 inside the pouch may be exposed to contamination, which is a problem particularly if the product 102 is a food product.

Depicted in FIGS. 2A to 6D is a pouch 200 having a valve that resists product leakage and is self-closing. More specifically, FIGS. 2A, 3A, 4A, 5A, and 6A depict first, second, third, fourth, and fifth instances, respectively, of a process of dispensing product from the pouch 200. FIGS. 2B, 3B, 4B, 5B, and 6B depict detail views of the tip of the pouch 200 shown in FIGS. 2A, 3A, 4A, 5A, and 6A, respectively. FIGS. 2C, 3C, 4C, 5C, and 6C depict front perspective views of the tip of the pouch 200 alone (e.g., without the product) at, respectively, the first instance shown in FIG. 2A, the second instance shown in FIG. 3A, the third instance shown in FIG. 4A, the fourth instance shown in FIG. 5A, and the fifth instance shown in FIG. 6A. FIGS. 2D, 3D, 4D, 5D, and 6D depict back perspective views of the tip of the pouch 200 alone (e.g., without the product) at, respectively, the first instance shown in FIG. 2A, the second instance shown in FIG. 3A, the third instance shown in FIG. 4A, the fourth instance shown in FIG. 5A, and the fifth instance shown in FIG. 6A.

The pouch 200 has a product 202 disposed therein. In the depicted embodiment, the product 202 is French dressing. In other embodiments, the product 202 can be any other type of product. The pouch 200 includes a first panel 204 and a second panel 206 that are sealed together about the pouch perimeter with one or more perimeter seals. In the depicted embodiment, the perimeter seals include a channel seal 210. The channel seal 210 is shaped to form a tip 212 from which the product 202 can be dispensed. In the depicted embodiment, the tip 212 is open.

The channel section of the pouch 200 includes a valve 224. In some embodiments, the valve 224 extends transversely across the channel section such that the product 202 flows through the valve 224 in order to pass from the main section of the pouch 200 to the tip 212 of the pouch 200. In some embodiments, the valve 224 extends substantially perpendicular to the flow of the product 102 and/or substantially parallel to the tip 212 of the pouch 200. In other embodiments, the valve 224 extends transversely across the channel section (e.g., from one side of the channel section to the other side of the channel section) along a path that is neither perpendicular to the flow of the product 202 nor parallel to the tip 212 of the pouch 200. The valve 224 has a curve that can be any type of crimp, crease, inflection, kink, or other form of a curve in the first and second panels 204 and 206. The cross-section of the valve 224 can be uniformly round (e.g., a semi-cylindrical crimp), can have a curvature of varying diameters (e.g., a non-uniform curvature), or have any other curved shape. In some embodiments, when the pouch 200 is in a resting state (e.g., no external forces are applied to the pouch 200), the valve 224 collapses the channel section of the pouch 200 to deter flow of the product 202 through the valve 224.

In the first instance shown in FIGS. 2A to 2D, the pouch 200 is in a resting state. In some embodiments, a pouch is in a resting state when no external forces (e.g., no forces other than natural forces, such as gravity, ambient air pressure, and the like) are applied to the pouch. In the resting state, the valve 224 in the channel section of the pouch 200 is curved such that the valve 224 deters flow of the product 202 through the valve 224. In some embodiments, the valve 224 collapses the channel to prevent flow of the product 202 through the valve 224 when the pouch 200 is in the resting state. In this condition, the product 202 does not flow or leak out of the tip 212.

In the second instance shown in FIGS. 3A to 3D, a user 226 begins to squeeze the pouch 200 to exert an external force on the exterior of the first and second panels 204 and 206 of the pouch 200. As the user 226 increases the external force on the pouch 200, the valve 224 begins to straighten. However, in this second instance, the pressure induced in the product 202 by the external force applied by the user 226 is insufficient to cause the valve 224 to open (e.g., to open completely). Thus, in the second instance, the product 202 is still not being dispensed from or leaking from the tip 212. In some embodiments, the first panel 204 is less rigid than the second panel 206 at the valve 224. Where the first panel 204 is less rigid than the second panel 206 at the valve 224, the second panel 206 may resist the straightening of the valve 224 due to the increased pressure. This resistance by the second panel 206 increases the ability of the user 226 to control when the product 202 is able to flow through the valve 224. Examples of pouches where the first panel is less rigid than the second panel at the valve are described in greater detail below.

Figure 4A:
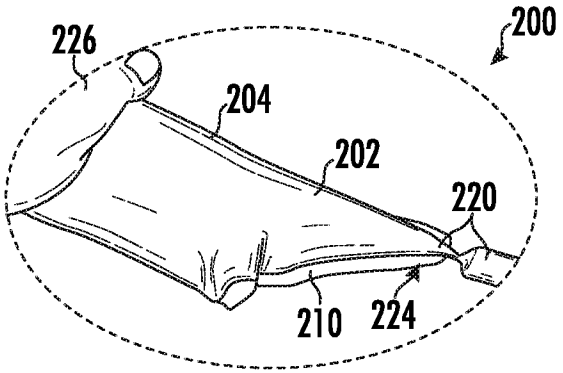
Figure 4B:
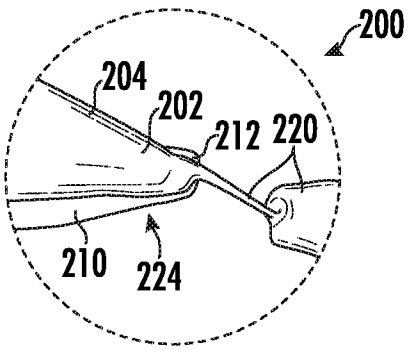
Figure 4C:
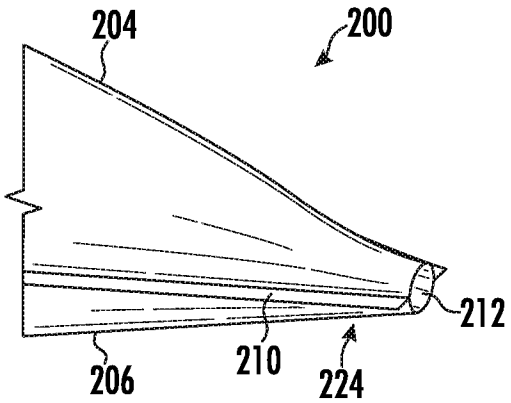
Figure 4D:
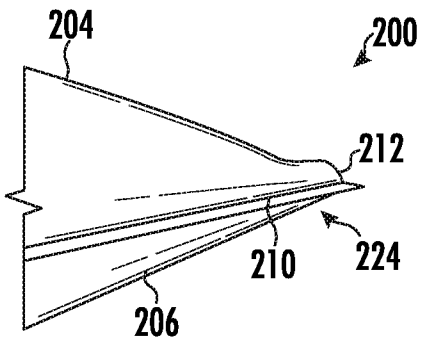
Figure 5B:
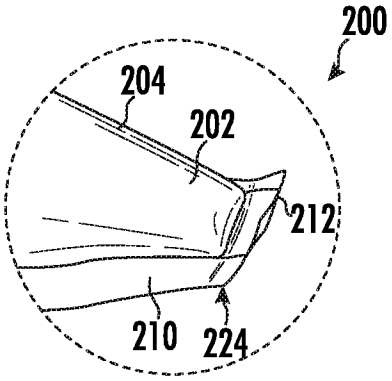
Figure 5D:
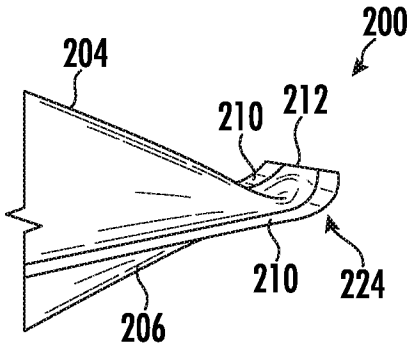
Figure 5A:
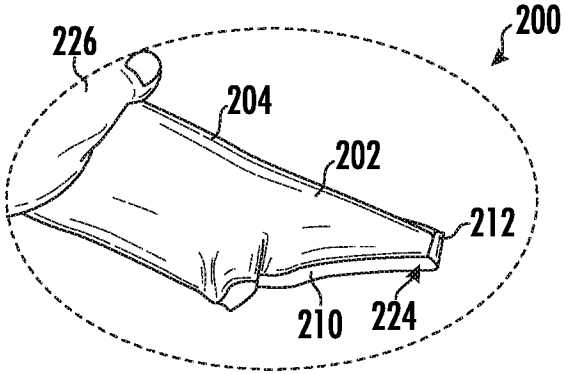
Figure 5C:
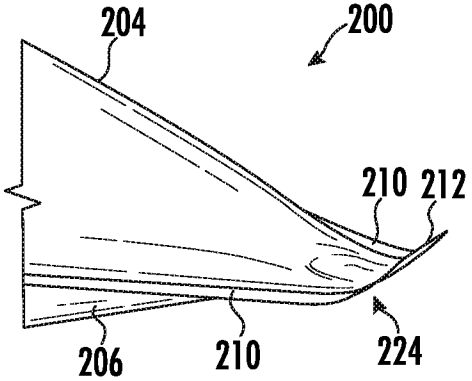
Figure 6B:
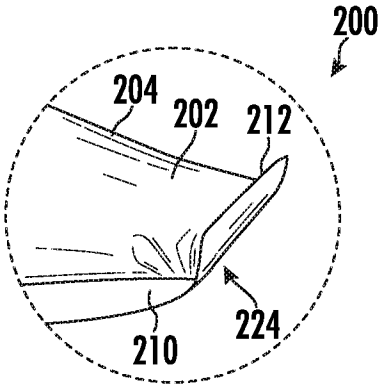
Figure 6D:
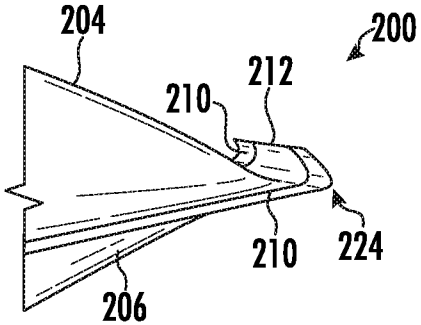
Figure 6A:
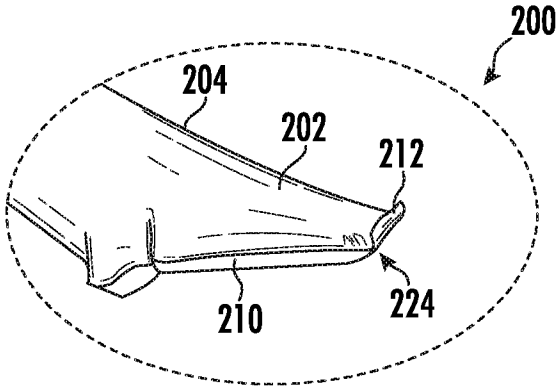
Figure 6C:
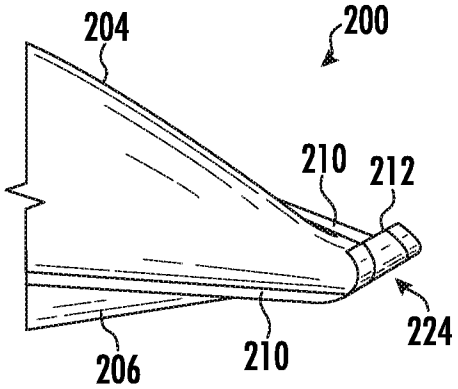

In the third instance shown in FIGS. 4A to 4D, the user 226 continues to squeeze the pouch 200. In this instance, the user 226 is exerting sufficient external force to induce a pressure in the product 202 that straightens the valve 224 at least partially open the valve 224. With the valve 224 open, the product 202 can flow through the valve 224 and be dispensed from the tip 212 as dispensed product 220. In the depicted embodiment, the dispensed product 220 initially exits the tip 212 of the pouch 200 as a stream. Once the stream of the dispensed product 220 reaches a surface (e.g., a counter, a container, etc.), the dispensed product 220 accumulates on the surface. In embodiments where the user 226 moves the pouch 200 while the product 202 is being dispensing, the product 220 can accumulate on the surface in lines, curves, or any other shape based on the movements of the pouch 200 by the user 226. As can be seen in FIG. 4C, the tip 212 of the pouch 200 in the depicted embodiment forms a round shape (e.g., oval shape or circle shape). The round shape of the tip 212 allows products that include particulates (e.g., tartar sauce, salsa, pickle relish, etc.) to be dispensed from the tip 212. In the depicted embodiment, as the product 202 flows through the curve of the valve 224, the product 202 flows by a convex side of the first panel 204 in the curve and a concave side of the second panel 206 in the curve.

In the fourth instance depicted in FIGS. 5A to 5D, the user 226 has reduced the amount of external force applied to the pouch 200 until the pressure induced in the product 202 is no longer sufficient to prevent the valve 224 from closing. As the valve 224 retracts, the valve 224 prevents the product 202 from flowing through the valve 224. The product 202 is no longer dispensed from the tip 212 and the product does not leak from the tip 212. In some embodiments, where the first panel 204 is less rigid than the second panel 206 at the valve 224, the second panel 206 may cause the tube shape of the channel section to collapse when the user 226 reduces the amount of external force applied to the pouch 200. This collapsing of the tube shape caused by the second panel 206 as a result of the reduced external force can cause the flow of product 202 through the valve 224 to cease before the valve 224 fully reaches its resting state. This collapsing action significantly reduces the possibility of inadvertent dispensing and/or leaking of the product 202 after the user stops dispensing the product 202. Examples of pouches where the first panel is less rigid than the second panel at the valve are described in greater detail below.

In the fifth instance shown in FIGS. 6A to 6D, the pouch 200 has returned to the resting state with the user 226 no longer exerting an external pressure on the pouch 200. In the resting state, the valve 224 in the channel section of the pouch 200 is curved such that the valve 224 deters flow of the product 202 through the valve 224. In some embodiments, the valve 224 collapses the channel to prevent flow of the product 202 through the valve 224 when the pouch 200 is in the resting state. In this condition, the product 202 does not flow or leak out of the tip 212.

In the series of the first to fifth instances shown in FIGS. 2A to 6D, the ability of the pouch 200 to dispense the product 202 when desired and to prevent flow of the product 202 when dispensing is not desired depends on the operation of the valve 224. In particular, it may be desirable for the valve 224 to function so that the valve 224 permits the product 202 to flow when the user 226 intends to dispense the product 202 and so that the valve 224 does not permit the product 202 to flow when the user 226 does not intend to dispense the product 202. For example, when the user 226 exerts a force on the pouch 200 that exceeds a threshold amount, the valve 224 should react by opening at least partially to permit the product 202 to flow to the tip 212. Similarly, when the user 226 exerts a force on the pouch 200 that does exceed the threshold amount and/or when the user 226 does not exert a force on the pouch 200, the valve 224 should react by closing to a position where the channel is collapsed and the product 202 is not able to flow to the tip 212.

For the product 202 to be dispensed from the pouch 200, the pressure induced in the product 202 by an external force will exceed a threshold that causes the curve in the valve 224 to straighten at least partially. A number of variables impact the ease or difficulty to sufficiently straighten the valve 224. Among those variables are the modulus of the material of the concave panel at the curve of the valve 224, the diameter of the curve of the valve 224, and the thickness of the material of the concave panel at the curve.

In some cases, the modulus of elasticity (or, as occasionally used herein and elsewhere, simply "modulus") can be the ratio of the stress applied to a material to the strain in the material. Stress can be defined as the ratio of force per area and strain can be defined as the percent change in length of the material due to the force applied. In the context of the valve 224, a force is applied to the second panel 206 by the pressure in the product 202 against the surface of the second panel 206 at the curve of the valve 224. The result of this force is the elastic deflection of the second panel 206 from the concave curve shape to a straighter shape. In general, a higher modulus necessitates a greater amount of force to open the valve 224. Conversely, a lower modulus allows the valve 224 to open with less force. This is analogous to a cantilevered beam in bending. A beam with a higher modulus (e.g., steel) will require more force to cause deflection than a beam with a lower modulus (e.g., wood). The elastic modulus of a material can also be described as its resistance to elastic deformation. This relationship is frequently referred to as the ratio of stress to strain. In some embodiments, the modulus of elasticity for a given material is measured as the Young's modulus according to ASTM E111-17. The modulus of a material is an intrinsic property of a material.

The thickness of a material also affects the amount of deflection for a given force. The thickness of the material relates to the amount of mass of the material that is strained during any deflection process. For example, between a thicker material and a thinner material that have the same modulus of elasticity, the thicker material would have more mass to be strained during any deflection process, thereby requiring a greater force to cause a deflection. Conversely, the thinner material would have less mass to be strained during any deflection process and would therefore require less force to cause a deflection. This is analogous to a cantilevered beam in bending. A thicker beam will require more force to cause deflection.

In the depicted embodiment, the valve 224 is formed from portions of the first and second panels 204 and 206 that are flexible (e.g., moveable) surfaces. In the case where the valve 224 is formed from a flexible surface, the pressure in the product 202 exerts an open force where the product 202 is in contact the flexible surfaces. Where the valve 224 has a curve transversely across the channel section, the pressure constantly applies a force against and normal to the surface of the first and second panels 204 and 206. The amount of deflection required to open the valve 224 is dependent on the total arc (or how far the material is curved in terms of degrees or radians) and is not necessarily dependent on the diameter of the curve. However, as the diameter of the curve increases, the ratio of surface available versus amount of deflection increases. And, as the surface area increases, a lower pressure is required to apply the same force. Thus, the greater the diameter of the curve in the valve 224, the lower the amount of pressure in the product 202 needed to open the valve. Similarly, the lower the diameter of the curve in the valve 224, the higher the amount of pressure in the product 202 needed to open the valve.

In embodiments where the valve 224 includes a curve transversely across the channel section, the valve 224 will have two panels that form the curve. In the depicted embodiment, the curve of the valve 224 is formed by the first panel 204 and the second panel 206. The first and second panels 204 and 206 are arranged so that, when the product 202 flows through the curve, the product 202 flows by a convex side of the first panel 204 in the curve and a concave side of the second panel 206 in the curve. Moreover, the portion of the first panel 204 that includes the curve is less rigid than the portion of the second panel 206 that includes the curve. In this context, the function of the valve 224 is affected significantly more by the second panel 206—the stiffer, concave panel—than the first panel 204—the less stiff, convex panel. Thus, in some cases, only the characteristics (e.g., the modulus of elasticity, the thickness, and the diameter) of the portion of the second panel 206 in the curve may need to be taken into account in order to determine the function of the valve 224.

Depicted in FIGS. 7A to 7D are side views of various embodiments of profiles of valves in the pouch 200. In each of the embodiments shown in FIGS. 7A to 7D, the pouch 200 includes a valve having a curve that extends transversely across a channel section. The valve is configured such that, when the product flows through the curve, the product flows by a convex side of the first panel 204 in the curve and a concave side of the second panel 206 in the curve. The pouch 200 is depicted in a resting state in each of the embodiments, with the product 202 located in the volume of the pouch 200 upstream of the valve but where the valve prevents flow of the product 202 past the valve 224.

Figure 7A:
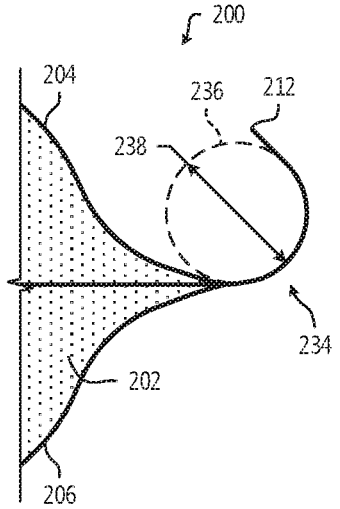
FIGS. 7A to 7D depict side views of various embodiments of valves in the pouch shown in FIGS. 2A to 6A, in accordance with the embodiments disclosed herein.

In FIG. 7A, the pouch 200 includes a valve 234 having a curve of substantially uniform curvature before straightening out before the tip 212. The substantially uniform curvature of the valve 234 is shown in the depiction by a circle 236 in dashed lines. The diameter of the valve 234 can be the diameter 238 of the curvature (e.g., the diameter of the circle 236). The modulus of elasticity of the valve 234 can be the modulus of elasticity of the second panel 206 in the curve. The thickness of the valve 234 can be the thickness of the second panel 206 in the curve.

Figure 7B:
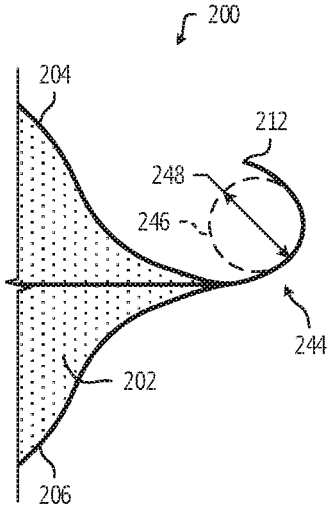

In FIG. 7B, the pouch 200 includes a valve 244 having a non-uniform curve leading up to the tip 212. In other words, the diameter of the curvature varies through the curve. In the depicted embodiment, a circle 246 is shown by a circle 236 in dashed lines at the most acute curvature of the valve 244. In some embodiments, the most acute curvature of the valve 244 has the greatest effect on the openability of the valve 244 because the most acute curvature of the valve 244 is the most difficult portion to force open. Thus, for purposes of determining or classifying the function of the valve 244, the diameter of the valve 244 can be the diameter 248 of the most acute curvature (e.g., the diameter of the circle 246) in the curve. The modulus of elasticity of the valve 244 can be the modulus of elasticity of the second panel 206 in the most acute curvature of the curve. The thickness of the valve 244 can be the thickness of the second panel 206 in the most acute curvature of the curve.

Figure 7C:
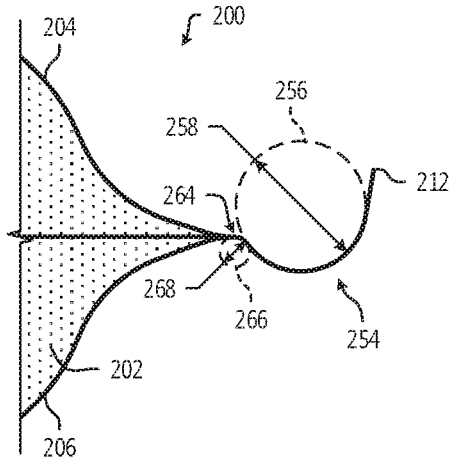

In FIG. 7C, the pouch 200 includes a valve 254 having a curve of substantially uniform curvature before straightening out near the tip 212. The substantially uniform curvature of the valve 254 is shown in the depiction by a circle 256 in dashed lines. The diameter of the valve 254 can be the diameter 258 of the curvature (e.g., the diameter of the circle 256). The modulus of elasticity of the valve 254 can be the modulus of elasticity of the second panel 206 in the curve. The thickness of the valve 254 can be the thickness of the second panel 206 in the curve. In FIG. 7C, the pouch 200 also includes a secondary curve 264 where the less rigid first panel 204 is a concave curve and the more rigid second panel 204 is a convex curve. The curvature of the secondary curve 264 is shown in the depiction by a circle 266 in dashed lines. The diameter of the secondary curve 264 is the diameter 268 of the curvature (e.g., the diameter of the circle 266). However, because the first panel 204 is less rigid than the second panel 206 and the first panel 204 has the concave curve in the secondary curve 264, the secondary curve 264 is much easier to open than the curve of the valve 254. Thus, while the secondary curve 264 is more acute that the curve of the valve 254, the characteristics of the secondary curve 264 would not have a significant effect on the operation of the valve 254.

Figure 7D:
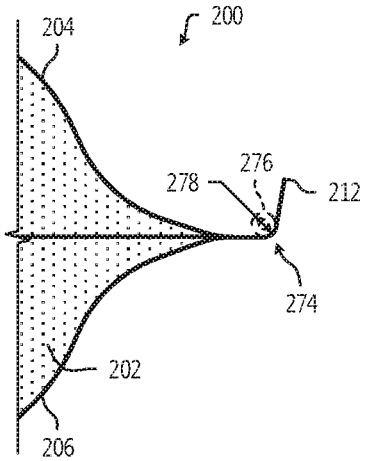

In FIG. 7D, the pouch 200 includes a valve 274 having a curve of substantially uniform curvature before straightening out near the tip 212. In the depicted embodiment, the valve 274 is a crimp that extends transversely across the channel section. Even though the crimp is creates the appearance of a fold, the result of the crimp results in a relatively small-diameter curve of the valve 274. The curvature of the valve 274 is shown in the depiction by a circle 276 in dashed lines. The diameter of the valve 274 can be the diameter 278 of the curvature (e.g., the diameter of the circle 276). The modulus of elasticity of the valve 274 can be the modulus of elasticity of the second panel 206 in the curve.

The thickness of the valve 274 can be the thickness of the second panel 206 in the curve.

In order to classify or predict the operation of any of the valves described herein, a valve deflection constant can be calculated based on the characteristics of the more rigid, concave panel in the valve. In some embodiments, the valve deflection constant can be based on one or more of the modulus of elasticity of the valve, the thickness of the material, and/or the diameter of the curve of the valve. As discussed above, in some embodiments, the pressure in the product required to open the valve (herein referred to as the "initiation pressure") can vary directly with the modulus of elasticity, directly with the thickness of the material, and indirectly with the diameter of the curve of the valve. For example, the valve deflection constant can be defined as:

$$C_{VD} = \frac{Et}{D}$$

where $C_{VD}$ is the valve deflection constant; E is a modulus or elasticity of the portion of the more rigid, concave panel in the curve; t is a thickness of the portion of the more rigid, concave panel in the curve; and D is a diameter of the concave side of the more rigid panel in the curve when the pouch is in a resting state. Examples of relationships between the valve deflection constant and the initiation pressure are described in greater detail below.

In embodiments disclosed herein, pouches include a valve formed from two panels, where the valve has a curve extending transversely across a channel section of the pouch, one panel is more rigid than the other, and an interior side of the more rigid panel is a concave curve in the valve. With these characteristics, the pouches can be formed with a variety of different structures and configurations. Depicted in FIGS. 8A to 9C are exploded views of various embodiments of structures and configurations for the pouches described herein.

Figure 8A:
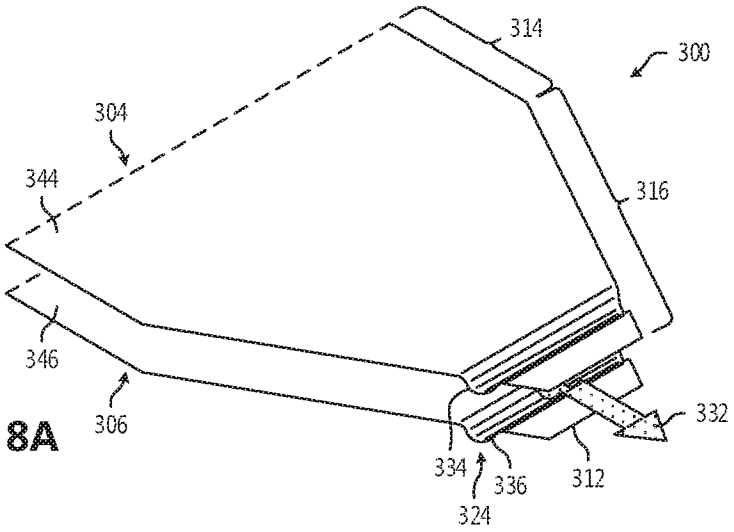
FIGS. 8A to 8C depict exploded views of various embodiments of structures and configurations of a pouch that has a centered tip design, in accordance with the embodiments disclosed herein.

FIG. 8A depicts a portion of a pouch 300. The pouch includes a first panel 304 and a second panel 306. In the depicted exploded view, the first and second panels 304 and 306 are separated from each other; however, the first and second panels 304 and 306 would otherwise be sealed to each other to form the pouch 300, including a main section 314 and a channel section 316 of the pouch 300. For example, the first and second panels 304 and 306 can be sealed to each other along one or both longitudinal sides of the main section 314 and the channel section 316. Although not shown in FIG. 8A, a product can be disposed in the main section 314 of the pouch 300 and the product is capable of flowing from the main section 314, through the channel section 316, and out of a tip 312. A dispensing path 332 of the product through the channel section 316 and out of the tip 312 is indicated in the figure by an arrow. In the depicted embodiment, the main section 314 has a substantially constant width and the channel section 316 has a narrowing width that narrows from the width of the main section 314 to the width of the tip 312. In the depicted embodiment, the tip 312 is substantially centered between the sides of the main section 314 (sometimes called a "centered tip" design).

The pouch 300 includes a valve 324 that extends transversely across the channel section 316. The valve 324 includes a curve that extends transversely across the channel section 316. The curve in the valve 324 is configured such that, when the product flows through the curve (e.g., along the path 332), the product flows by a convex side of the first panel 304 in the curve and a concave side of the second panel 306 in the curve. The curve in the valve 324 includes a portion 334 of the first panel 304 and a portion 336 of the second panel 306. In some embodiments, the portion 334 of the first panel 304 that includes the curve is less rigid than the portion 336 of the second panel 306 that includes the curve. In the depicted embodiment, the first panel 304 includes a film 344 and the second panel 306 includes a film 346. The film 346 of the second panel 306 has a rigidity that is greater than the film 344 of the first panel 304 so that, in the valve 324, the product passes by the concave side of the more rigid film 346 and the convex side of the less rigid film 344. For example, the film 346 can have a greater thickness and/or a higher modulus of elasticity than the film 344.

Figure 9A:
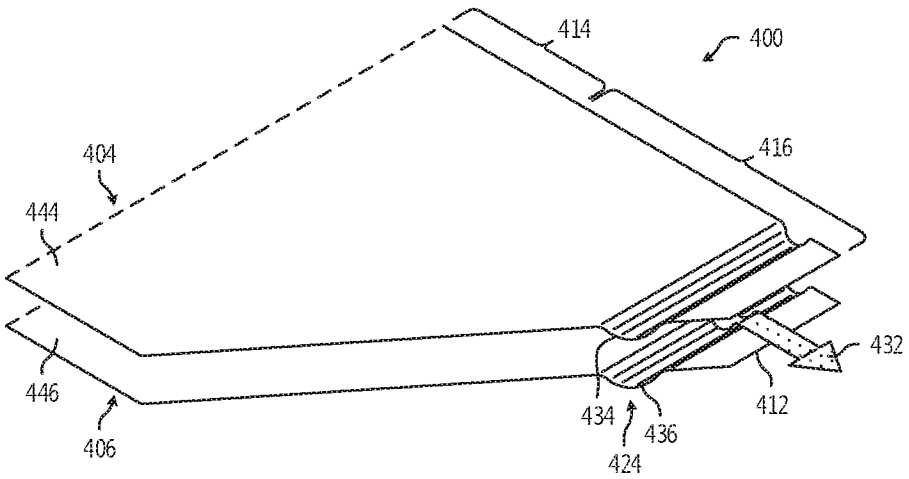
FIGS. 9A to 9C depict exploded views of various embodiments of structures and configurations of a pouch that has a piping tip design, in accordance with the embodiments disclosed herein.

FIG. 9A depicts a portion of a pouch 400. The pouch includes a first panel 404 and a second panel 406. In the depicted exploded view, the first and second panels 404 and 406 are separated from each other; however, the first and second panels 404 and 406 would otherwise be sealed to each other to form the pouch 400, including a main section 414 and a channel section 416 of the pouch 400. For example, the first and second panels 404 and 406 can be sealed to each other along one or both longitudinal sides of the main section 414 and the channel section 416. Although not shown in the depiction, a product can be disposed in the main section 414 of the pouch 400 and the product is capable of flowing from the main section 414, through the channel section 416, and out of a tip 412. A dispensing path 432 of the product through the channel section 416 and out of the tip 412 is indicated in the figure by an arrow. In the depicted embodiment, the main section 414 has a substantially constant width and the channel section 416 has a narrowing width that narrows from the width of the main section 414 to the width of the tip 412. In the depicted embodiment, the tip 412 is substantially aligned with one side of the pouch 400 (sometimes called a "piping bag" design).

The pouch 400 includes a valve 424 that extends transversely across the channel section 416. The valve 424 includes a curve that extends transversely across the channel section 416. The curve in the valve 424 is configured such that, when the product flows through the curve (e.g., along the path 432), the product flows by a convex side of the first panel 404 in the curve and a concave side of the second panel 406 in the curve. The curve in the valve 424 includes a portion 434 of the first panel 404 and a portion 436 of the second panel 406. In some embodiments, the portion 434 of the first panel 404 that includes the curve is less rigid than the portion 436 of the second panel 406 that includes the curve. In the depicted embodiment, the first panel 404 includes a film 444 and the second panel 406 includes a film 446. The film 446 of the second panel 406 has a rigidity that is greater than the film 444 of the first panel 404 so that, in the valve 424, the product passes by the concave side of the more rigid film 446 and the convex side of the less rigid film 444.

Figure 8B:
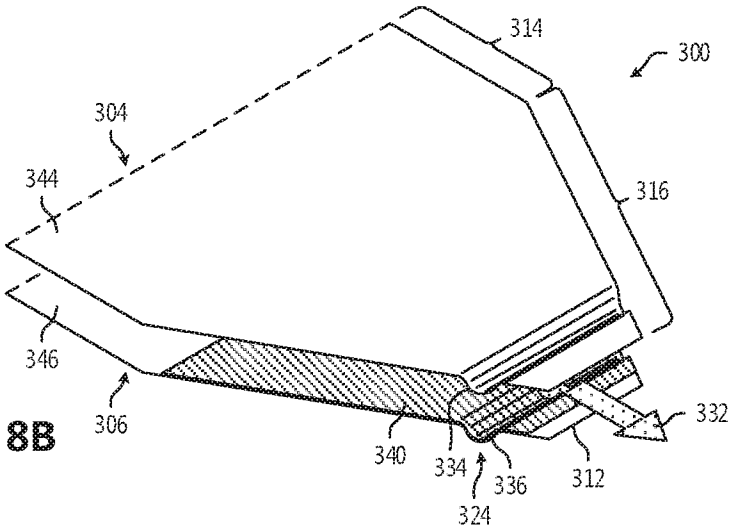

FIG. 8B depicts a variation of the pouch 300 shown in FIG. 8A. In FIG. 8B, the first panel 304 includes the film 344 and the second panel 306 includes the film 346 and a stiffening layer 340. In the depicted embodiment, the stiffening layer 340 is adhered to the film 346. As can be seen in the depicted embodiment, the path 332 of the product, when passing through the valve 324, passes by the concave side of the stiffening layer 340. In some embodiments, the stiffening layer 340 has a rigidity that is greater than a rigidity of each of the film 344 of the first panel 304 and the film 346 of the second panel 306. In some embodiments, the film 344 and the film 346 have substantially the same rigidity. For example, the film 344 and the film 346 can be formed from a single sheet of film that is folded between the film 344 and the film 346. Where the film 344 and the film 346 have substantially the same rigidity, the portion 336 of the second panel 306 has a greater rigidity than the portion 334 of the first panel 304 due to the additional rigidity of the stiffening layer 340. In some embodiments, the rigidity of the stiffening layer 340 is substantially greater than the rigidity of the film 346 such that the valve deflection constant can be calculated based only on the characteristics of the stiffening layer 340 (e.g., the characteristics of the film 346 can be ignored during the calculation of the valve deflection constant). In some embodiments, the valve deflection constant can be calculated based only on the stiffening layer 340 when the rigidity of the film 346 is less than or equal to one or more of 25%, 20%, 15%, 10%, or 5% of the rigidity of the stiffening layer 340.

Figure 9B:
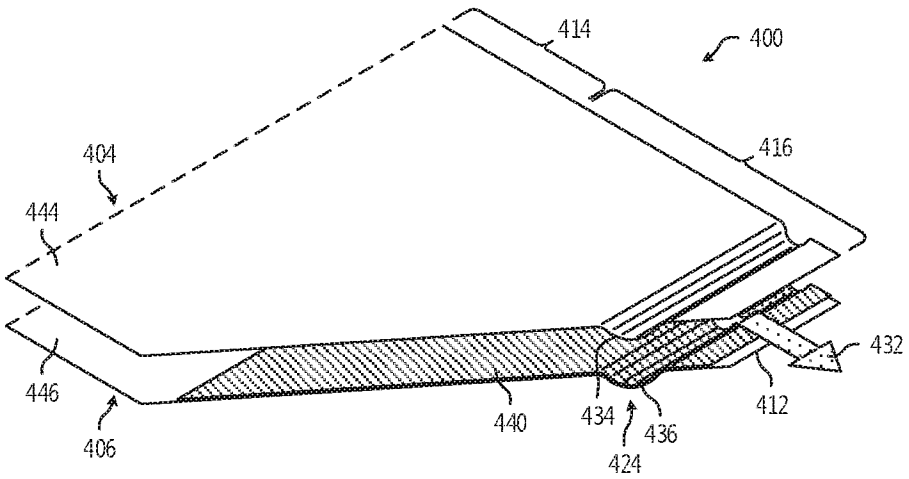

FIG. 9B depicts a variation of the pouch 400 shown in FIG. 9A. In FIG. 9B, the first panel 404 includes the film 444 and the second panel 406 includes the film 446 and a stiffening layer 440. In the depicted embodiment, the stiffening layer 440 is adhered to the film 446. As can be seen in the depicted embodiment, the path 432 of the product, when passing through the valve 424, passes by the concave side of the stiffening layer 440. In some embodiments, the stiffening layer 440 has a rigidity that is greater than a rigidity of each of the film 444 of the first panel 404 and the film 446 of the second panel 406. In some embodiments, the film 444 and the film 446 have substantially the same rigidity. For example, the film 444 and the film 446 can be formed from a single sheet of film that is folded between the film 444 and the film 446 to form the pouch 400. Where the film 444 and the film 446 have substantially the same rigidity, the portion 436 of the second panel 406 has a greater rigidity than the portion 434 of the first panel 404 due to the additional rigidity of the stiffening layer 440. In some embodiments, the rigidity of the stiffening layer 440 is substantially greater than the rigidity of the film 446 such that the valve deflection constant can be calculated based only on the characteristics of the stiffening layer 440 (e.g., the characteristics of the film 446 can be ignored during the calculation of the valve deflection constant). In some embodiments, the valve deflection constant can be calculated based only on the stiffening layer 440 when the rigidity of the film 446 is less than or equal to one or more of 25%, 20%, 15%, 10%, or 5% of the rigidity of the stiffening layer 440.

Figure 8C:
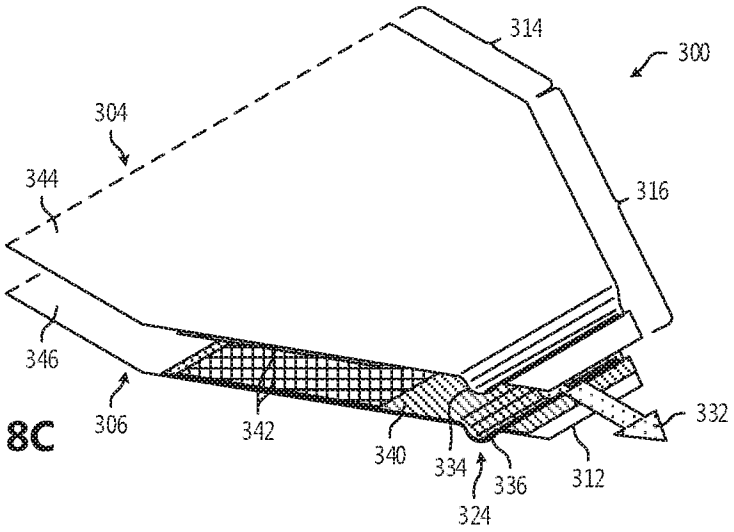

FIG. 8C depicts a variation of the pouch 300 shown in FIG. 8B. In FIG. 8C, the first panel 304 includes the film 344 and the second panel 306 includes the film 346 and the stiffening layer 340. The pouch 300 in FIG. 8C also includes a frangible seal 342. In some embodiments, the frangible seal 342 is located between the main section 314 and the valve 324. In the depicted embodiment, the frangible seal 342 includes two labels. An outer face of a first label is permanently adhered to the film 344 and an outer face of a second label is permanently adhered to the stiffening layer 440. In other embodiments, such as the embodiment shown in FIG. 8A, the outer face of the second label can be permanently adhered to the film 346. In the exploded view shown in FIG. 8C, the inner faces of the labels are separated from each other; however, the inner faces of the labels may not otherwise be separated from each other. In some embodiments, before the first dispensing of the product from the pouch 300, a peelable sealant layer is positioned adjacent to each of the inner surfaces of the two labels. In this way, the product disposed in the main section 314 is prevented from flowing to the valve 324 by the frangible seal 342. The peelable sealant can have a seal strength, such as a strength less than or equal to about 5 pounds per square inch (34.5 kPa), such that a user can break the seal between the two labels by exerting an external force on the pouch to induce a pressure in the product that exceeds the seal strength of the frangible seal 342. Embodiments of frangible seals are described in the above-incorporated U.S. Patent Application Publication No. 2006/0093765 and U.S. Pat. Nos. 6,983,839 and 10,179,343.

Figure 9C:
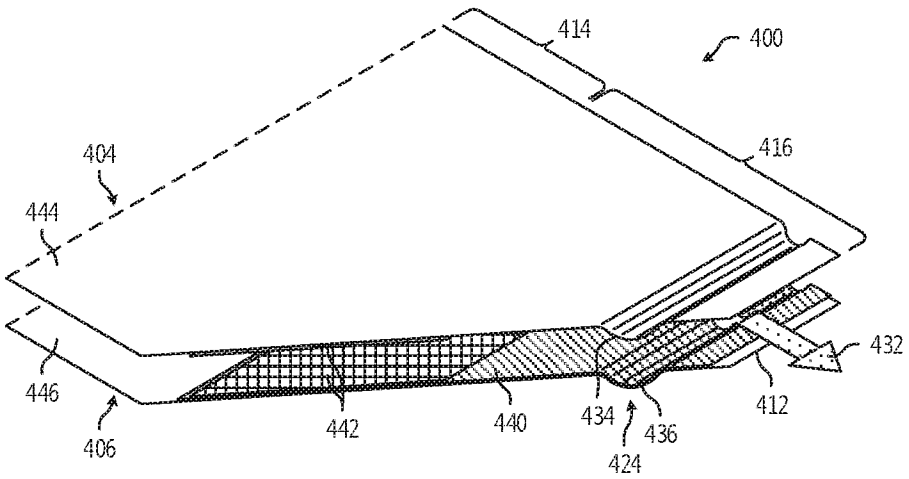

FIG. 9C depicts a variation of the pouch 400 shown in FIG. 9B. In FIG. 9C, the first panel 404 includes the film 444 and the second panel 406 includes the film 446 and the stiffening layer 440. The pouch 400 in FIG. 9C also includes a frangible seal 442. In some embodiments, the frangible seal 442 is located between the main section 414 and the valve 424. In the depicted embodiment, the frangible seal 442 includes two labels. An outer face of a first label is permanently adhered to the film 444 and an outer face of a second label is permanently adhered to the stiffening layer 440. In other embodiments, such as the embodiment shown in FIG. 9A, the outer face of the second label can be permanently adhered to the film 446. In the exploded view shown in FIG. 9C, the inner faces of the labels are separated from each other; however, the inner faces of the labels may not otherwise be separated from each other. In some embodiments, before the first dispensing of the product from the pouch 400, a peelable sealant layer is positioned adjacent to each of the inner surfaces of the two labels. In this way, the product disposed in the main section 414 is prevented from flowing to the valve 424 by the frangible seal 442. The peelable sealant can have a seal strength, such as a strength less than or equal to about 5 pounds per square inch (34.5 kPa), such that a user can break the seal between the two labels by exerting an external force on the pouch to induce a pressure in the product that exceeds the seal strength of the frangible seal 442.

Figure 10A:
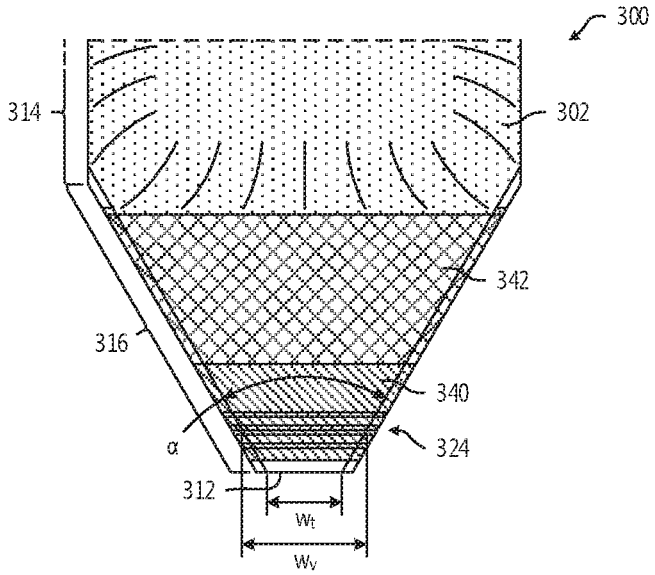
FIGS. 10A and 10B depict front and side views, respectively, of the embodiment of the pouch shown in FIG. 8C with a product disposed in the main section, in accordance with the embodiments disclosed herein.
Figure 10B:
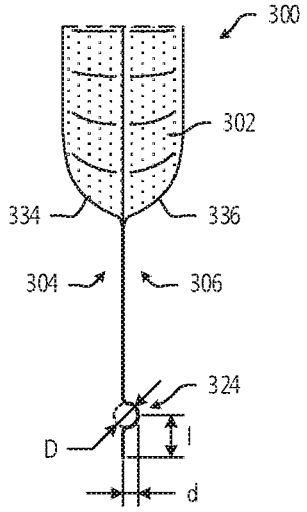

Depicted in FIGS. 10A and 10B are front and side views, respectively, of the embodiment of the pouch 300 shown in FIG. 8C with a product 302 disposed in the main section 314. In the embodiment depicted, the frangible seal 342 has not yet been broken (e.g., before the first dispensing of the product 302 from the pouch 300) and the frangible seal 342 is preventing the product 302 from flowing to the valve 324. As noted above, the valve deflection constant of the second panel 306 (e.g., the valve deflection constant of the stiffening layer 340) can be indicative of the operation of the valve 324, such as the amount of initiation pressure needed to open the valve 324 and permit the product 302 to flow through the valve 324. The valve deflection constant can be based on one or more of the modulus of elasticity of the portion 336 second panel 306 in the valve 324, the thickness of the material of the portion 336 second panel 306 in the valve 324, and/or the diameter of the curve (shown as D in the depiction) of the portion 336 second panel 306 in the valve 324. FIGS. 10A and 10B also depicted other characteristics that may affect the function of the valve, such as one or more of a width $w_t$ of the tip 312, a width $w_v$ of the valve 324, a depth d of the valve 324, a length l from the tip 312 to the valve 324, or an angle $\alpha$ between respective sides of the channel section 316.

Figure 11A:
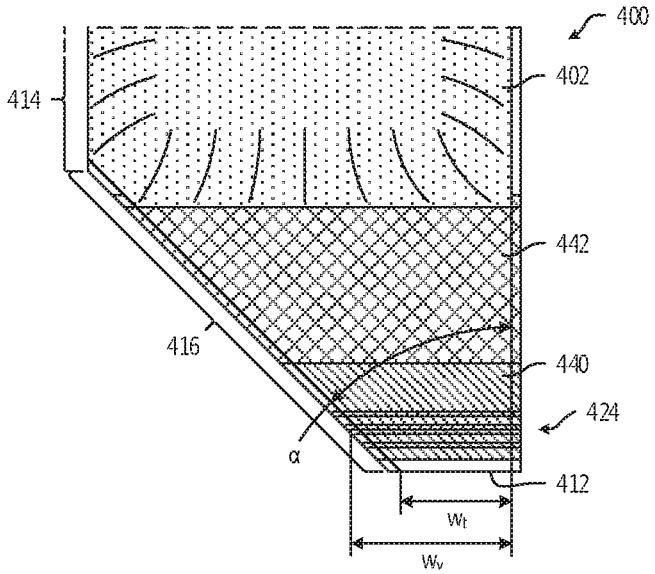
FIGS. 11A and 11B depict front and side views, respectively, of the embodiment of the pouch shown in FIG. 9C with a product disposed in the main section, in accordance with the embodiments disclosed herein.
Figure 11B:
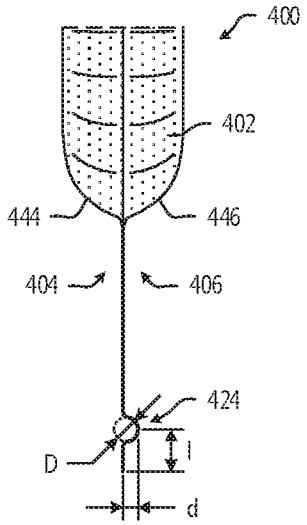

Depicted in FIGS. 11A and 11B are front and side views, respectively, of the embodiment of the pouch 400 shown in FIG. 9C with a product 402 disposed in the main section 414. In the embodiment depicted, the frangible seal 442 has not yet been broken (e.g., before the first dispensing of the product 402 from the pouch 400) and the frangible seal 442 is preventing the product 402 from flowing to the valve 424. As noted above, the valve deflection constant of the second panel 406 (e.g., the valve deflection constant of the stiffening layer 440) can be indicative of the operation of the valve 424, such as the amount of initiation pressure needed to open the valve 424 and permit the product 402 to flow through the valve 424. The valve deflection constant can be based on one or more of the modulus of modulus of elasticity of the portion 436 second panel 406 in the valve 424, the thickness of the material of the portion 436 second panel 406 in the valve 424, and/or the diameter of the curve (shown as D in the depiction) of the portion 436 second panel 406 in the valve 424. FIGS. 11A and 11B also depicted other characteristics that may affect the function of the valve, such as one or more of a width $w_t$ of the tip 412, a width $w_v$ of the valve 424, a depth d of the valve 424, a length l from the tip 412 to the valve 424, or an angle $\alpha$ between respective sides of the channel section 416.

In any of the embodiments disclosed herein, the initiation pressure of a valve can be the pressure in the product at which the valve opens sufficiently to permit the product to flow through the valve. The initiation pressure of a pouch is a significant factor in the "feel" of the pouch to a user and the effectiveness of the function of the pouch. In one example, if the initiation pressure is lower than a lower pressure threshold, the valve will be very slow to close or may not close at all. Valves with very low initiation pressures may allow product to leak or to be dispensed with very little external force. For example, the product may leak out of the pouch with the small force applied to the pouch when a user merely picks up the pouch. This can result in dispensing the product from the pouch when the user does not intend to dispense the product from the pouch. In some embodiments, the lower pressure threshold is at or about 0.4 psi (2.8 kPa).

In another example, if the initiation pressure is higher than an upper pressure threshold, the user will need to apply a significant force on the exterior of the pouch in order to induce sufficient pressure in the product to dispense the product. Not only may it be difficult for a user to apply such a force to the exterior of the pouch, such a significant force applied by the user can cause damage to the pouch. Examples of such damage include deformation of one of the first and second panels where the user exerts the force, deformation of one of the first and second panels due to bulging from the product, breaching of a seal between the first and second panels, and the like. In addition, when the valve opens only after reaching or exceeding the upper pressure threshold, the flow rate through the valve may be very high due to the high pressure in the product. This may result in the user dispensing a higher volume of the product than desired as soon as the valve is opened. In some embodiments, the upper pressure threshold is at or about 3.4 psi (23.4 kPa).

In some cases, the range between the lower pressure threshold and the upper pressure threshold is considered a "functional" pressure range. In some embodiments, the functional pressure range is a range (i) in which a user can open the value without applying force that may deform the pouch and (ii) in which the valve will likely not allow the product to flow when the user does not intend to dispense the product. In some embodiments, the functional pressure range is between about 0.4 psi (2.8 kPa) and about 3.4 psi (23.4 kPa). In some embodiments, pouches with valves having an initiation pressure in the functional pressure range are suitable for use in a wide variety of settings.

In some embodiments, pouches with valves having an initiation pressure in a specific pressure range within the functional pressure range may be particularly adept for certain settings. In some embodiments, it may be advantageous for the specific pressure range to have a lower specific pressure threshold that is higher that the lower pressure threshold of the functional pressure range. For example, in the embodiment where the functional pressure range has a lower pressure threshold of 0.4 psi (2.8 kPa), a specific pressure range may have a lower specific pressure threshold of 0.9 psi (6.2 kPa). Valves having an initiation pressure at or above the lower specific pressure threshold may exhibit desirable "spring back" characteristics, such as faster closing of the valve as the user reduces the force on the exterior of the pouch, greater likelihood that the valve will not leak when dispensing is not intended, and the like. In some embodiments, it may be advantageous for the specific pressure range to have an upper specific pressure threshold that is lower that the upper pressure threshold of the functional pressure range. For example, in the embodiment where the functional pressure range has an upper pressure threshold of 3.4 psi (23.4 kPa), a specific pressure range may have an upper specific pressure threshold of 1.6 psi (11.0 kPa). Valves having an initiation pressure at or below the upper specific pressure threshold may be easier for a user to open (e.g., less force needs to be applied to the exterior of the pouch to open the valve), the flow rate of the product out of the pouch may be more easily controlled, and the like. In some embodiments, it may be advantageous for the specific pressure range to have a lower specific pressure threshold that is higher that the lower pressure threshold of the functional pressure range and an upper specific pressure threshold that is lower that the upper pressure threshold of the functional pressure range. For example, in the embodiment where the functional pressure range has a lower pressure threshold of 0.4 psi (2.8 kPa) and an upper pressure threshold of 3.4 psi (23.4 kPa), a specific pressure range may have a lower specific pressure threshold of 0.9 psi (6.2 kPa) and an upper specific pressure threshold of 1.6 psi (11.0 kPa).

As noted above, the initiation pressure of a valve in a pouch may be related to the valve deflection constant of the valve. This relationship was tested using pouches similar to the embodiment of the pouch 400 shown in FIG. 9B. In the tested pouches, the film 444 and the film 446 were made from the same "body film" that was 2.5 mil (0.0635 mm) thick, include a first linear low-density polyethylene (LLDPE) layer with a thickness of 1 mil (0.0254 mm), a polyamide layer with a thickness of 0.5 mil (0.0127 mm), and a second LLDPE layer with a thickness of 1 mil (0.0254 mm). The film 444 and the film 446 were formed by folding a single sheet of the body film and sealing the body film to itself so that the fold between the film 444 and the film 446 was on one longitudinal side of the pouch and a seal between the film 444 and the film 446 was on the other longitudinal side of the pouch. The body film had a modulus of elasticity of 70 kpsi (483 MPa).

A number of different stiffening layers 440 were tested in the pouches. Some of the pouches had a stiffening layer 440 made from a semi-rigid polymer sheet with a primary bulk layer of polyvinyl chloride adjacent to a thin tie layer and a thin sealant layer (referred to herein as a "PVC" stiffening layer). The adhesive layer of the PVC stiffening layer was used to adhere the stiffening layer 440 to the film 446. PVC stiffening layers with thickness of 8.2 mil (0.208 mm), 12.2 mil (0.310 mm), and 17.2 mil (0.437 mm) were used in various ones of the tested pouches. Others of the pouches had a stiffening layer 440 made from a semi-rigid polymer sheet with a primary bulk layer of polyethylene terephthalate glycol adjacent to a thin tie layer and a thin sealant layer (referred to herein as a "PETG" stiffening layer). The adhesive layer of the PETG stiffening layer was used to adhere the stiffening layer 440 to the film 446. PETG stiffening layers with thickness of 7.6 mil (0.193 mm) and 8.6 mil (0.218 mm) were used in various ones of the tested pouches.

The valve 424 was formed in the channel section 416 of each pouch by crimping the channel section 416 using a cylindrical rod. A number of rods of varying diameters were used to crimp the pouches so that the pouches with a number of different curve diameters were used. After crimping, the minimum diameter of the concave side of the stiffening layer 440 was measured to determine the diameter of the curve of the valve 424. Measured diameters varied from 0.125 in (0.318 cm) to 0.531 (1.349 cm).

A valve deflection constant was calculated for each of the pouches. In this embodiment, the valve deflection constant was calculated as:

$$C_{VD} = \frac{Et}{D}$$

where $C_{VD}$ was the valve deflection constant; E was the modulus of elasticity of the portion of the stiffening layer 440 that includes the concave curve; t is a thickness of the stiffening layer 440; and D is a diameter of the concave side of the stiffening layer 440 in a resting state. In this embodiment, the valve deflection constant was calculated based on the stiffening layer 440 and did not include the portion of the film 446 in the valve 424. One reason why the valve deflection constant was calculated based on the stiffening layer 440 alone related to the respective products of the thickness and the modulus of elasticity (Ext) of the film 446 and the stiffening layer 440. In particular, the ratio of the product of the thickness and the modulus of elasticity of the film 446 to the product of the thickness and the modulus of elasticity of the stiffening layer 440 in the tested pouches was between 1:19.6 and 1:9.35. In some cases, the valve deflection constant can be calculated based on the stiffening layer 440 alone if the ratio of the product of the thickness and the modulus of elasticity of the film 446 to the product of the thickness and the modulus of elasticity of the stiffening layer 440 is less than or equal to about 1:4. This relationship can be stated as:

$$\frac{E_f \times t_f}{E_s \times t_s} \leq \frac{1}{4}$$

where $E_f$ is the modulus of elasticity of the film 446, $t_f$ is the thickness of the film 446, $E_s$ is the modulus of elasticity of the stiffening layer 440, and $t_s$ is the thickness of the stiffening layer 440. In other embodiments, the valve deflection constant can be calculated based on a portion of the entire first panel 404—including both the stiffening layer 440 and the film 446—in the valve 424.

Once the pouches were formed and the valve deflection constant for each pouch was calculated, the initiation pressure of each pouch was measured. More specifically, the pouches were placed into a parallel plate compression where a force was applied to the exterior of the pouch as the plates closed. The pressure in the product was measured at the point when valve opened to releasing product through the spout. The measured pressure at this point was recorded as the initiation pressure for the valve of the pouch. Provided here in Table 1 are the results of the tested pouches. For each tested pouch, Table 1 includes the material type of the stiffening layer, the thickness of the stiffening layer, the modulus of elasticity of the stiffening layer, the measured curve diameter of the stiffening layer, the calculated valve deflection constant, and the measured initiation pressure.

TABLE 1

Examples of Initiation Pressure Based on Valve Deflection Constant

| Stiffening Layer Material Type | Stiffening Layer Thickness, t (mil) | Modulus of Elasticity, E (kpsi) | Curve Diameter, D (in) | Valve Deflection Constant, E*t/D (kpsi) | Initiation Pressure, P (psi) | Film Thickness, t (μm) | Modulus of Elasticity, E (MPa) | Curve Diameter, D (cm) | Valve Deflection Constant, E*t/D (MPa) | Initiation Pressure, P (kPa) |
|---|---|---|---|---|---|---|---|---|---|---|
| PVC | 8.2 | 289.2 | 0.484 | 4.914 | 0.19 | 208 | 1994 | 1.229 | 33.9 | 1.3 |
| PVC | 8.2 | 289.2 | 0.469 | 5.078 | 0.22 | 208 | 1994 | 1.191 | 35.0 | 1.5 |
| PVC | 8.2 | 289.2 | 0.469 | 5.078 | 0.23 | 208 | 1994 | 1.191 | 35.0 | 1.6 |
| PVC | 8.2 | 289.2 | 0.453 | 5.253 | 0.23 | 208 | 1994 | 1.151 | 36.2 | 1.6 |
| PVC | 8.2 | 289.2 | 0.438 | 5.44 | 0.4 | 208 | 1994 | 1.113 | 37.5 | 2.8 |
| PVC | 8.2 | 289.2 | 0.391 | 6.093 | 0.27 | 208 | 1994 | 0.993 | 42.0 | 1.9 |
| PVC | 12.2 | 279.3 | 0.531 | 6.388 | 0.59 | 310 | 1926 | 1.349 | 44.0 | 4.1 |
| PVC | 12.2 | 279.3 | 0.531 | 6.388 | 0.62 | 310 | 1926 | 1.349 | 44.0 | 4.3 |
| PVC | 12.2 | 279.3 | 0.531 | 6.388 | 0.45 | 310 | 1926 | 1.349 | 44.0 | 3.1 |
| PVC | 12.2 | 279.3 | 0.531 | 6.388 | 0.43 | 310 | 1926 | 1.349 | 44.0 | 3.0 |
| PETG | 7.6 | 215.9 | 0.25 | 6.563 | 0.43 | 193 | 1489 | 0.635 | 45.3 | 3.0 |
| PETG | 7.6 | 215.9 | 0.25 | 6.563 | 0.36 | 193 | 1489 | 0.635 | 45.3 | 2.5 |
| PVC | 8.2 | 289.2 | 0.359 | 6.623 | 0.37 | 208 | 1994 | 0.912 | 45.7 | 2.6 |
| PVC | 8.2 | 289.2 | 0.359 | 6.623 | 0.25 | 208 | 1994 | 0.912 | 45.7 | 1.7 |
| PETG | 7.6 | 215.9 | 0.234 | 7.001 | 0.69 | 193 | 1489 | 0.594 | 48.3 | 4.8 |
| PVC | 12.2 | 279.3 | 0.484 | 7.006 | 0.82 | 310 | 1926 | 1.229 | 48.3 | 5.7 |
| PVC | 12.2 | 279.3 | 0.469 | 7.239 | 1.08 | 310 | 1926 | 1.191 | 49.9 | 7.4 |
| PVC | 8.2 | 289.2 | 0.328 | 7.254 | 0.53 | 208 | 1994 | 0.833 | 50.0 | 3.7 |
| PETG | 8.6 | 215.9 | 0.25 | 7.427 | 0.49 | 218 | 1489 | 0.635 | 51.2 | 3.4 |
| PETG | 8.6 | 215.9 | 0.25 | 7.427 | 0.58 | 218 | 1489 | 0.635 | 51.2 | 4.0 |
| PVC | 12.2 | 279.3 | 0.453 | 7.489 | 1.06 | 310 | 1926 | 1.151 | 51.6 | 7.3 |
| PETG | 8.6 | 215.9 | 0.234 | 7.922 | 0.82 | 218 | 1489 | 0.594 | 54.6 | 5.7 |
| PVC | 8.2 | 289.2 | 0.297 | 8.017 | 0.55 | 208 | 1994 | 0.754 | 55.3 | 3.8 |
| PVC | 12.2 | 279.3 | 0.422 | 8.044 | 1.26 | 310 | 1926 | 1.072 | 55.5 | 8.7 |

TABLE 1-continued

Examples of Initiation Pressure Based on Valve Deflection Constant

| Stiffening Layer Material Type | Stiffening Layer Thickness, t (mil) | Modulus of Elasticity, E (kpsi) | Curve Diameter, D (in) | Valve Deflection Constant, E*t/D (kpsi) | Initiation Pressure, P (psi) | Film Thickness, t (μm) | Modulus of Elasticity, E (MPa) | Curve Diameter, D (cm) | Valve Deflection Constant, E*t/D (MPa) | Initiation Pressure, P (kPa) |
|---|---|---|---|---|---|---|---|---|---|---|
| PETG | 7.6 | 215.9 | 0.203 | 8.078 | 0.56 | 193 | 1489 | 0.516 | 55.7 | 3.9 |
| PETG | 7.6 | 215.9 | 0.203 | 8.078 | 0.77 | 193 | 1489 | 0.516 | 55.7 | 5.3 |
| PVC | 8.2 | 289.2 | 0.281 | 8.463 | 0.71 | 208 | 1994 | 0.714 | 58.4 | 4.9 |
| PVC | 12.2 | 279.3 | 0.391 | 8.687 | 1.54 | 310 | 1926 | 0.993 | 59.9 | 10.6 |
| PETG | 7.6 | 215.9 | 0.188 | 8.751 | 0.71 | 193 | 1489 | 0.478 | 60.3 | 4.9 |
| PVC | 12.2 | 279.3 | 0.375 | 9.049 | 1.14 | 310 | 1926 | 0.953 | 62.4 | 7.9 |
| PVC | 12.2 | 279.3 | 0.375 | 9.049 | 1.37 | 310 | 1926 | 0.953 | 62.4 | 9.4 |
| PETG | 8.6 | 215.9 | 0.203 | 9.141 | 1.37 | 218 | 1489 | 0.516 | 63.0 | 9.4 |
| PVC | 17.2 | 256.8 | 0.469 | 9.405 | 1.19 | 437 | 1771 | 1.191 | 64.8 | 8.2 |
| PVC | 8.2 | 289.2 | 0.25 | 9.52 | 0.66 | 208 | 1994 | 0.635 | 65.6 | 4.6 |
| PVC | 8.2 | 289.2 | 0.25 | 9.52 | 0.5 | 208 | 1994 | 0.635 | 65.6 | 3.4 |
| PETG | 8.6 | 215.9 | 0.188 | 9.903 | 0.72 | 218 | 1489 | 0.478 | 68.3 | 5.0 |
| PETG | 8.6 | 215.9 | 0.188 | 9.903 | 1.06 | 218 | 1489 | 0.478 | 68.3 | 7.3 |
| PETG | 8.6 | 215.9 | 0.188 | 9.903 | 1.19 | 218 | 1489 | 0.478 | 68.3 | 8.2 |
| PVC | 8.2 | 289.2 | 0.234 | 10.155 | 0.43 | 208 | 1994 | 0.594 | 70.0 | 3.0 |
| PVC | 8.2 | 289.2 | 0.234 | 10.155 | 1.5 | 208 | 1994 | 0.594 | 70.0 | 10.3 |
| PETG | 7.6 | 215.9 | 0.156 | 10.501 | 1.02 | 193 | 1489 | 0.396 | 72.4 | 7.0 |
| PETG | 8.6 | 215.9 | 0.172 | 10.803 | 1.44 | 218 | 1489 | 0.437 | 74.5 | 9.9 |
| PETG | 8.6 | 215.9 | 0.172 | 10.803 | 1.3 | 218 | 1489 | 0.437 | 74.5 | 9.0 |
| PETG | 8.6 | 215.9 | 0.172 | 10.803 | 2.18 | 218 | 1489 | 0.437 | 74.5 | 15.0 |
| PVC | 12.2 | 279.3 | 0.313 | 10.859 | 2.42 | 310 | 1926 | 0.795 | 74.9 | 16.7 |
| PVC | 12.2 | 279.3 | 0.313 | 10.859 | 2.41 | 310 | 1926 | 0.795 | 74.9 | 16.6 |
| PVC | 12.2 | 279.3 | 0.313 | 10.859 | 2.28 | 310 | 1926 | 0.795 | 74.9 | 15.7 |
| PETG | 8.6 | 215.9 | 0.156 | 11.883 | 1.03 | 218 | 1489 | 0.396 | 81.9 | 7.1 |
| PETG | 8.6 | 215.9 | 0.156 | 11.883 | 1.39 | 218 | 1489 | 0.396 | 81.9 | 9.6 |
| PVC | 8.2 | 289.2 | 0.188 | 12.694 | 1.14 | 208 | 1994 | 0.478 | 87.5 | 7.9 |
| PETG | 7.6 | 215.9 | 0.125 | 13.127 | 1.9 | 193 | 1489 | 0.318 | 90.5 | 13.1 |
| PETG | 7.6 | 215.9 | 0.125 | 13.127 | 1.94 | 193 | 1489 | 0.318 | 90.5 | 13.4 |
| PETG | 8.6 | 215.9 | 0.141 | 13.203 | 3.24 | 218 | 1489 | 0.358 | 91.0 | 22.3 |
| PVC | 12.2 | 279.3 | 0.25 | 13.574 | 4.7 | 310 | 1926 | 0.635 | 93.6 | 32.4 |
| PVC | 12.2 | 279.3 | 0.25 | 13.574 | 3.32 | 310 | 1926 | 0.635 | 93.6 | 22.9 |
| PVC | 8.2 | 289.2 | 0.172 | 13.848 | 2.59 | 208 | 1994 | 0.437 | 95.5 | 17.9 |
| PVC | 12.2 | 279.3 | 0.203 | 16.706 | 3.91 | 310 | 1926 | 0.516 | 115 | 27.0 |
| PVC | 12.2 | 279.3 | 0.188 | 18.099 | 6.39 | 310 | 1926 | 0.478 | 125 | 44.1 |
| PVC | 12.2 | 279.3 | 0.188 | 18.099 | 5.69 | 310 | 1926 | 0.478 | 125 | 39.2 |

Figure 12:
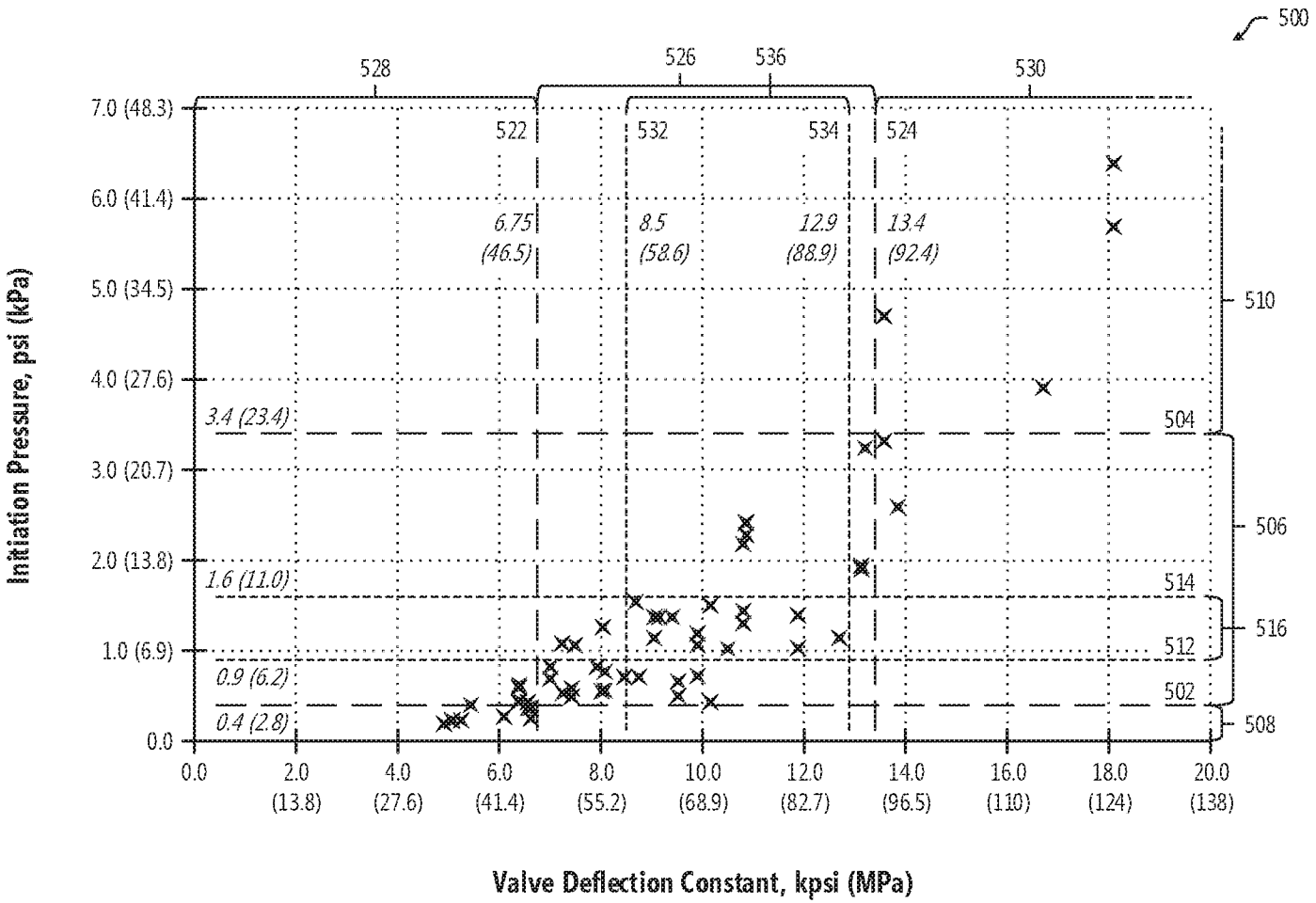
FIG. 12 depicts a chart of measured initiation pressure plotted against the calculated valve deflection constant of tested pouches, in accordance with the embodiments disclosed herein.

FIG. 12 depicts a chart 500 of the measured initiation pressure in Table 1 plotted against the calculated valve deflection constant. As can be seen, there appears to be a relationship between the calculated valve deflection constant and the measured initiation pressure. In particular, a lower calculated valve deflection constant corresponds with a lower initiation pressure and a higher calculated valve deflection constant corresponds with a higher initiation pressure.

The chart 500 shows a lower pressure threshold 502 and an upper pressure threshold 504. The lower pressure threshold 502 and the upper pressure threshold 504 form the boundaries of a functional pressure range 506. In the depicted embodiment, the lower pressure threshold 502 is 0.4 psi (2.8 kPa) and the upper pressure threshold 504 is 3.4 psi (23.4 kPa). Thus, the functional pressure range 506 in the depicted embodiment is a range between about 0.4 psi (2.8 kPa) and about 3.4 psi (23.4 kPa). Below the functional pressure range 506 is a lower non-functional pressure range 508. In the depicted embodiment, the lower non-functional pressure range 508 is below about 0.4 psi (2.8 kPa). In the lower non-functional pressure range 508, pouch valves may not fully close after dispensing, resulting in leaking of product or inadvertent dispensing of product when applying low forces to the exterior of the pouch. Above the functional pressure range 506 is an upper non-functional pressure range 510. In the depicted embodiment, the upper non-functional pressure range 510 is above about 3.4 psi (23.4 kPa). In the upper non-functional pressure range 510, pouch valves may not open without an unreasonably high force applied to the outside of the pouch, resulting in deformation of the pouch due to the high force or dispensing of higher-than-desired volumes of product as soon as the valve opens.

In the depicted embodiment, the chart 500 shows a lower specific pressure threshold 512 and an upper specific pressure threshold 514. The lower specific pressure threshold 512 and the upper specific pressure threshold 514 form the boundaries of a specific pressure range 516 that falls within the functional pressure range 506. In the depicted embodiment, the lower specific pressure threshold 512 is 0.9 psi (6.2 kPa) and the upper specific pressure threshold 514 is 1.6 psi (11.0 kPa). In some embodiments, the pouches with valves having an initiation pressure in a specific pressure range within the functional pressure range may be particularly adept for certain settings. For example, valves having an initiation pressure at or above the lower specific pressure threshold may exhibit desirable spring back characteristics and valves having an initiation pressure at or below the upper specific pressure threshold may be easy for a user to dispense product and/or control the flow rate of the product being dispensed.

As can be seen in the chart 500, some of the tested pouches fell in each of the functional pressure range 506, the lower non-functional pressure range 508, the upper non-functional pressure range 510, and the specific pressure range 516. In general, the tested pouches that fell in the lower non-functional pressure range 508 had lower valve deflection constant values. The chart 500 shows a lower valve deflection constant (VDC) threshold 522, below which all of the tested pouches in the lower non-functional pressure range 508 fell. In the depicted embodiment, the lower VDC threshold 522 is 6.75 kpsi (46.5 MPa). The range of valve deflection constants below the lower VDC threshold 522 is a low-functional VDC range 528 where most of the test pouches fell outside of the functional pressure range 506. Thus, in some embodiments, it would be advantageous for a pouch to be designed so that the valve deflection constant is at or above the lower VDC threshold 522.

In general, the tested pouches that fell in the upper non-functional pressure range 510 had higher valve deflection constant values. The chart 500 shows an upper VDC threshold 524, above which all of the tested pouches in the upper non-functional pressure range 510 fell. In the depicted embodiment, the upper VDC threshold 524 is 13.4 kpsi (92.4 MPa). The range of valve deflection constants above the upper VDC threshold 524 is a low-functional VDC range 530 where most of the test pouches fell outside of the functional pressure range 506. Thus, in some embodiments, it would be advantageous for a pouch to be designed so that the valve deflection constant of the pouch is at or below the upper VDC threshold 524.

Between the lower VDC threshold 522 and the upper VDC threshold 524 is a functional VDC range 526. In the depicted embodiment, all of the tested pouches with a valve deflection constant in the functional VDC range 526 also had an initiation pressure in the functional pressure range 506. Thus, in some embodiments, it would be advantageous for a pouch to be designed so that the valve deflection constant of the pouch is in the functional VDC range 526. In the depicted embodiment, it would be advantageous for a pouch to be designed so that the valve deflection constant of the pouch is in the functional VDC range 526 between about 6.75 kpsi (46.5 MPa) and about 13.4 kpsi (92.4 MPa).

While all of the pouches in the functional VDC range 526 have an initiation pressure in the functional pressure range 506, not all of the pouches with valve deflection constants in the functional VDC range 526 may have a desired initiation pressure for a particular situation. For example, it may be advantageous for the pouches to have an initiation pressure that falls within the specific pressure range 516. As can be seen in the chart 500, the pouches with valve deflection constants toward the lower end of the functional VDC range 526 tend to have initiation pressures that are below the specific pressure range 516. Similarly, the pouches with valve deflection constants toward the upper end of the functional VDC range 526 tend to have initiation pressures that are above the specific pressure range 516.

In some embodiments, it may be advantageous to for a higher percentage of the pouches to have initiation pressures that fall within the specific pressure range 516. The chart 500 shows a lower specific VDC threshold 532. In the depicted embodiment, the lower specific VDC threshold 532 is selected such that a majority of the pouches with initiation pressures in the functional pressure range 506 but below the specific pressure range 516 fall below the lower specific VDC threshold 532. In the depicted embodiment, the lower specific VDC threshold 532 is 8.5 kpsi (58.6 MPa). The chart 500 shows an upper specific VDC threshold 534. In the depicted embodiment, the upper specific VDC threshold 534 is selected such that a majority of the pouches with initiation pressures in the functional pressure range 506 but above the specific pressure range 516 fall above the upper specific VDC threshold 534. In the depicted embodiment, the lower specific VDC threshold 532 is 12.9 kpsi (88.8 MPa). In some embodiments, the lower specific VDC threshold 532 and the upper specific VDC threshold 534 bound a specific VDC range 536. In some embodiments, the lower specific VDC threshold 532 and the upper specific VDC threshold 534 are selected such that a majority of the pouches with valve deflection constants in the specific VDC range 536 have initiation pressures in the specific pressure range 516. Thus, in the depicted embodiment, it may be advantageous for a pouch to be designed so that the valve deflection constant of the pouch is in the specific VDC range 536 between about 8.5 kpsi (58.6 MPa) and about 12.9 kpsi (88.8 MPa).

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A package comprising:

a first panel;

a second panel, wherein the first and second panels are sealed to each other to form a pouch, wherein the pouch includes a main section and a channel section; and a product disposed within the pouch, wherein the product is capable of flowing from the main section through the channel section to a tip of the pouch;

wherein the pouch includes a valve that has a curve extending transversely across the channel section, wherein the curve is configured such that, when the product flows through the curve, the product flows by a convex side of the first panel in the curve and a concave side of the second panel in the curve;

wherein a portion of the first panel that includes the curve is less rigid than a portion of the second panel that includes the curve.

2. The package of claim 1, wherein an initiation pressure of the valve is in a range from about 0.4 psi (2.8 kPa) to about 3.4 psi (23.4 kPa).

3. The package of claim 1, wherein an initiation pressure of the valve is in a range from about 0.9 psi (6.2 kPa) to about 1.6 psi (11.0 kPa).

4. The package of claim 1, wherein the portion of the second panel that includes the curve has a valve deflection constant defined as:

$$C_{VD} = \frac{Et}{D}$$

where CVD is the valve deflection constant, E is a modulus of elasticity of the portion of the second panel, t is a thickness of the portion of the second panel, and D is a diameter of the concave side of the second panel in the curve when the pouch is in a resting state.

5. The package of claim 4, wherein the valve deflection constant is in a range from about 6.75 kpsi (46.5 MPa) to about 13.5 kpsi (92.4 MPa).

6. The package of claim 4, wherein the valve deflection constant is in a range from about 8.5 kpsi (58.6 MPa) to about 12.9 kpsi (88.9 MPa).

7. The package of claim 4, wherein the portion of the first panel that includes the curve has a valve deflection constant that is less than or equal to at least one of 40% of the valve deflection constant of the portion of the second panel, 20% of the valve deflection constant of the portion of the second panel, or 10% of the valve deflection constant of the portion of the second panel.

8. The package of claim 4, wherein the diameter of the concave side of the second panel in the curve is a diameter of a most acute curvature of the concave side of the second panel in the curve.

9. The package of claim 1, wherein the first panel includes a first film and the second panel includes a second film.

10. The package of claim 9, wherein a rigidity of the second film is greater than a rigidity of the first film.

11. The package of claim 9, wherein the second panel further includes a stiffening layer adhered to the second film, and wherein the portion of the second panel in the curve includes the stiffening layer.

12. The package of claim 11, wherein a rigidity of the second film is substantially the same as a rigidity of the first film.

13. The package of claim 11, wherein the first film and the second film are formed from a single sheet of film that is folded between the first and second films.

14. The package of claim 11, wherein the portion of the second panel that includes the curve has a valve deflection constant defined as:

$$C_{VD} = \frac{Et}{D}$$

where CVD is the valve deflection constant, E is a modulus of elasticity of the stiffening layer, t is a thickness of the portion of the stiffening layer, and D is a diameter of the concave side of the stiffening layer in the curve when the pouch is in a resting state.

15. The package of claim 11, wherein a ratio of a product of a thickness and a modulus of elasticity of the second film to a product of a thickness and a modulus of elasticity of the stiffening layer is less than or equal to about 1:4.

16. The package of claim 1, further comprising:

a frangible seal between the first and second panels located such that the valve is between the tip of the package and the frangible seal, wherein, before the frangible seal is broken, the frangible seal is configured to deter flow of the product to the valve.

17. A method of dispensing a product from a package, wherein the package includes a first panel and a second panel, wherein the first and second panels are sealed to each other to form a pouch, wherein the pouch includes a main section and a channel section, and wherein a product disposed within the main section of the pouch, the method comprising:

applying an external force to the main section of the pouch, wherein applying the external force causes:

the product to flow from the main section to a valve in the channel section, wherein the valve has a curve extending transversely across the channel section, the curve in the valve to straighten at least partially from a shape of the curve in a resting state of the pouch, the product to flow through the curve by a convex side of the first panel in the curve and a concave side of the second panel in the curve, and the product to be dispensed from a tip of the pouch wherein a portion of the first panel that includes the curve is less rigid than a portion of the second panel that includes the curve; and reducing the external force applied to the main section of the pouch, wherein reducing the external force causes the valve to return to the shape of the curve in a resting state of the pouch to deter flow of the product through the valve.

18. The method of claim 17, wherein the applying the external force to the main section of the pouch comprises manually applying the external force to the main section of the pouch.

19. The method of claim 17, wherein applying the external force further causes a break of a frangible seal in the pouch, and wherein, before the frangible seal is broken, the frangible seal is between the first and second panels and located such that the valve is between the tip of the pouch and the frangible seal.

20. The method of claim 17, further comprising:

opening the tip of the pouch before applying the external force.

* * * * *